US005788114A

United States Patent [19]

Perego

[11] Patent Number: 5,788,114

[45] Date of Patent: Aug. 4, 1998

[54] CD PACKAGING SYSTEM AND METHOD INCLUDING A CASE-FEEDING UNIT A UNIT FOR INDIVIDUALLY FEEDING BROCHURES TO A PICKUP STATION AND AN APPARATUS FOR PACKAGING COMPACT DISCS INTO RESPECTIVE CASES

[75] Inventor: Luciano Perego, Milan, Italy

[73] Assignee: Tapematic U.S.A., Inc., Orlando, Fla.

[21] Appl. No.: 591,906

[22] Filed: Jan. 25, 1996

[51] Int. Cl.[6] ..... B65B 43/44; B65B 43/48

[52] U.S. Cl. ..... 221/11; 221/281; 53/468; 53/389.1

[58] Field of Search ..... 221/11, 147, 148, 221/149, 174, 281, 208; 53/284.5, 389.1, 468

[56] References Cited

U.S. PATENT DOCUMENTS

| | | | |
|---|---|---|---|
| 2,370,848 | 3/1945 | Doggett | 221/11 |
| 2,374,168 | 4/1945 | Bowman | 221/11 |
| 2,769,570 | 11/1956 | Adams | 221/11 X |
| 3,648,889 | 3/1972 | Greaves et al. | 221/11 |
| 4,170,861 | 10/1979 | Snyder et al. | 53/284.5 X |
| 4,297,826 | 11/1981 | Woertche | 53/284.5 X |
| 5,664,405 | 9/1997 | Perego | 53/284.5 X |

*Primary Examiner*—Horace M. Culver
*Attorney, Agent, or Firm*—Frommer Lawrence & Haug, LLP

[57] ABSTRACT

A system for packaging manufactured articles into respective cases along a feed line having an apparatus with stations for performing various functions, a unit for automatically stacking and feeding CD cases to be packaged in these stations and a unit for dispensing brochures or leaflets to be packaged in the CD at one of the stations. The automatic case feeding unit transfers a new stack, manually arranged, before a feed magazine into the feed magazine when it is sensed that the current stack is below a predetermined level. A pusher member is actuated to move the new stack into position in the feed magazine. The brochure feeding unit draws a bottom brochure via a conveyor belt from a stack of brochures, while the remaining brochures are retained by a partition element. The withdrawn brochure is stopped at a locating member, wherein the height of its back edge is reduced by pusher element so the brochure passes under the locating member and is passed to the corresponding packaging station. The CD packaging machine has multiple stations including one for opening the cases, one for inserting brochures or leaflets, one for inserting a compact disc in a tray and one for closing the cases. The opening and closing stations work via a combination of mechanical elements and air blowing nozzles.

13 Claims, 9 Drawing Sheets

1
2
2a
3
4
5
6
7
8
9
9a
10
11a
11b
12
14
15
16
16a
17
18
19
20
21
22
23
24
24a
25
26

4
3
4
4
25
24
26
19
24
7
18
26
20
23
6
21
14
12
17
15
16
13
18
16
17

33
32
33c
55
33a
33b
"Z"
46b
46
54
37
50
54a
34
53
33a
33b 33
32
33c
55
33b
33a
50
46b
46
54
37
34
33b
33a 30
47
33
"R"
33b
49
51a
51
54a
33a
54b
46
46b
47a
44
39
46a
48
45
40
43
42
34
37
50
54
53
32

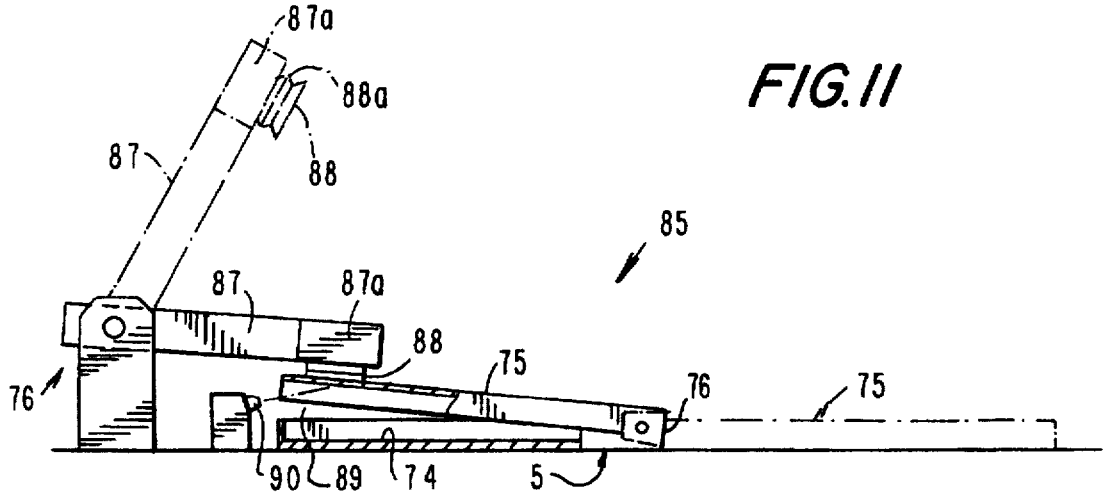
FIG. 11
FIG. 12
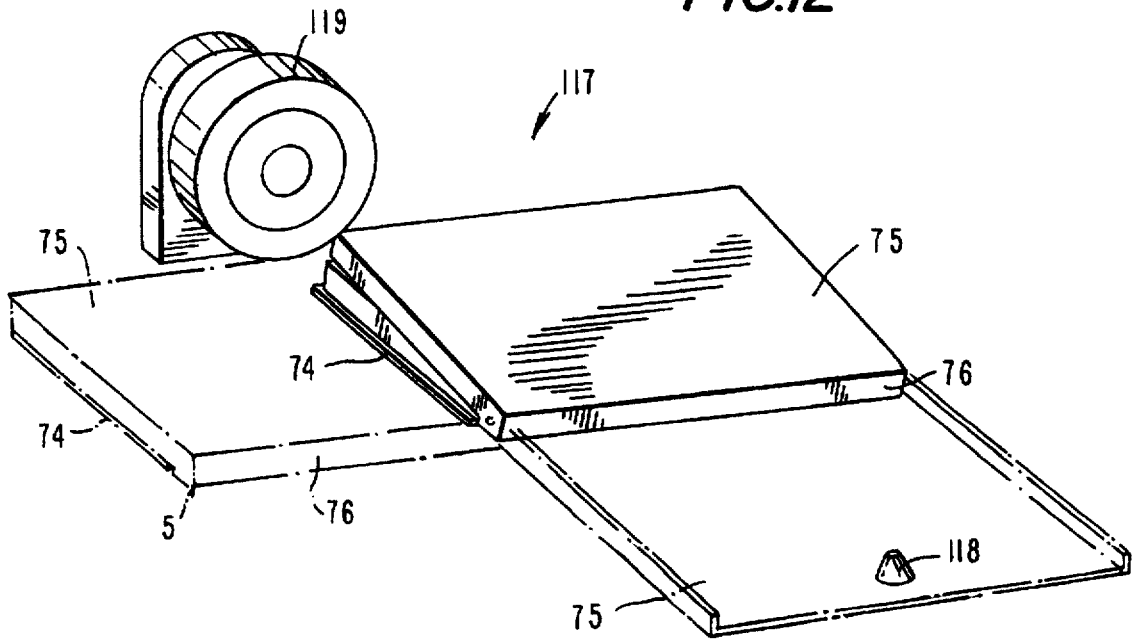

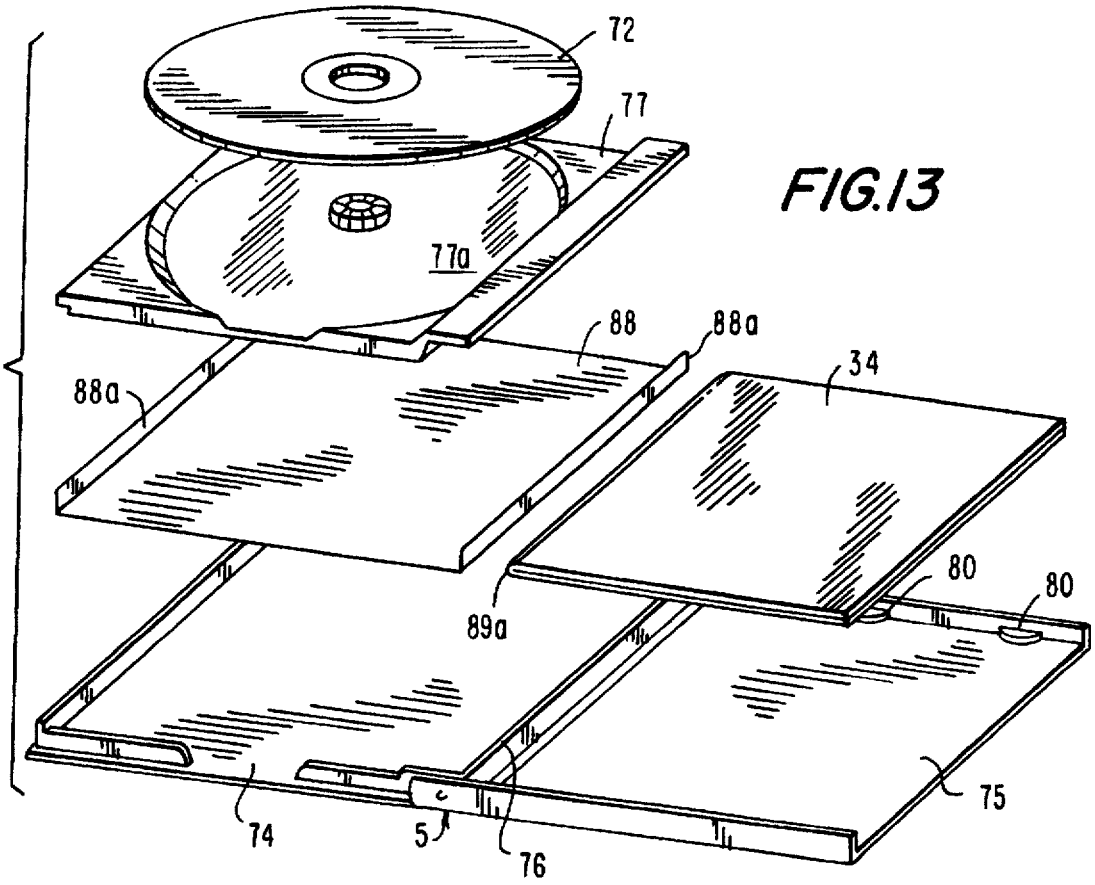
FIG.13
FIG.14
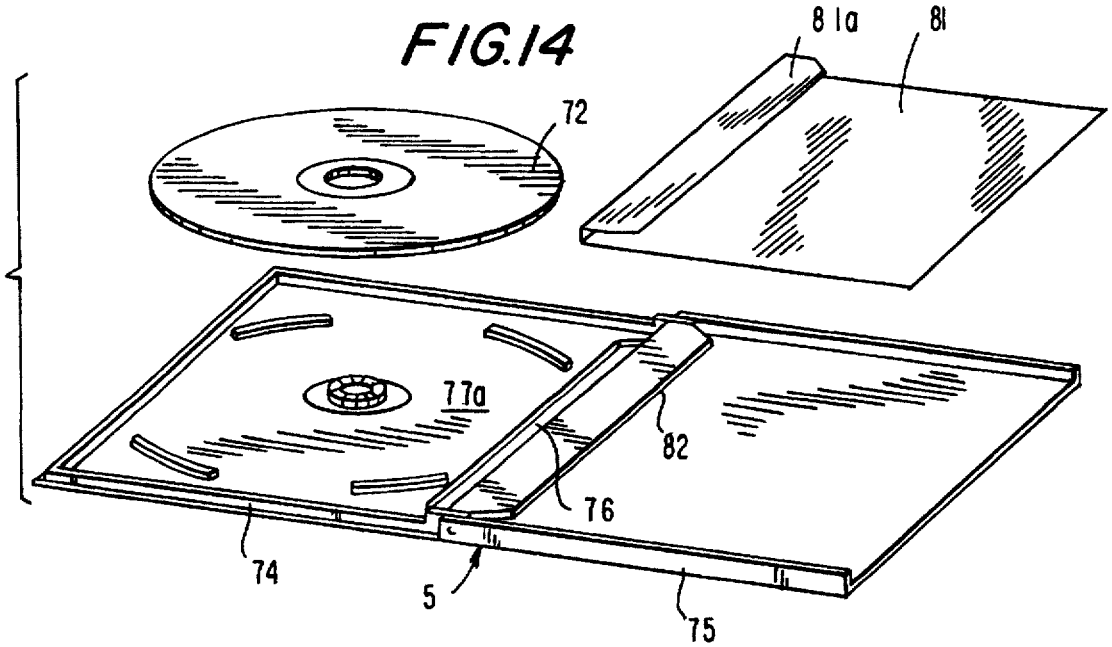

CD PACKAGING SYSTEM AND METHOD INCLUDING A CASE-FEEDING UNIT A UNIT FOR INDIVIDUALLY FEEDING BROCHURES TO A PICKUP STATION AND AN APPARATUS FOR PACKAGING COMPACT DISCS INTO RESPECTIVE CASES

FIELD OF THE INVENTION

The present invention relates to a packaging system for inserting manufactured articles into cases. The system is automated to require the minimum of human activity and to still maintain a compact structure. The packaging system includes a case-feeding unit, a unit for individually feeding brochures and an apparatus having multiple stations for inserting these articles into the cases.

The present invention relates to a case-feeding unit for sequentially supplying plastic cases for use with automatic apparatus for packaging compact discs into those cases. In addition, the present invention may be utilized for feeding the same compact disc packaging apparatus with trays, or with cases containing the compact discs.

The present invention relates to a unit for individually feeding brochures to a pick-up station, and more particularly, to a unit for individually feeding brochures to pick-up station wherein a belt conveyor terminates at the pick-up station used in conjunction with an apparatus for packaging compact discs into respective cases. This feeding unit supplies the compact disc packaging apparatus with booklets, covers or leaflets (hereinafter collectively referred to as "brochures") to be inserted into the compact disc cases as a result of mechanical handling devices provided in the packaging apparatus.

The present invention relates to an apparatus for packaging compact discs into respective cases of the type having a housing portion on which a lid portion is laterally hinged. The lid portion is movable between a closed condition, wherein the lid portion lies upon the housing portion, and an open condition, wherein the lid portion extends in coplanar relation with the housing portion. The present invention also relates to a packaging method for compact discs performed by the apparatus described.

BACKGROUND OF THE INVENTION

Optical discs, usually referred to as compact discs and used for recording sounds and images and/or storing data for computers, are generally packaged into appropriate box-shaped cases formed of plastic material. The packaging operation is performed by means of apparatus operating in a completely automatic manner. Such apparatus receives the individual cases from a feeding station and causes the cases to progress according to a stepping motion along a feed line which has a plurality of work stations distributed thereon. Each of the work stations is designed to perform a particular operating step during the packaging cycle. More particularly, the work stations provided along this apparatus include a case-opening station, one or more work stations for introducing at least one compact disc and a tray, if necessary, into the case, one or more auxiliary work stations for introducing informational booklets, covers or the like into the case, and a final case-closing station.

In designing the above apparatus, efforts have been directed to increase the productivity and automation of same, while minimizing the operators' interventions for periodically supplying the different work stations with the components which are to be introduced into the cases. In addition to these objectives, efforts have been made to reduce the bulkiness of the apparatus as much as possible.

In earlier case-feeding units, the feeding magazine is composed of three vertically-extending walls disposed consecutively to form a U-shaped profile. Between the ends of this U-shaped profile, an entrance side is provided through which vertically stacked empty cases can be introduced into the magazine.

The feeding unit is also provided with an appropriate case separation mechanism operating adjacent to the lower end of the feeding magazine so that the individual cases can be received from the end portion of said stack which becomes increasingly shorter as the cases are removed to be transferred along the feed line of the packaging apparatus.

When the case stack is exhausted or close to exhaustion, the operator must introduce a new case stack into the magazine in order to continue to supply the packaging apparatus with cases.

For obvious practical reasons connected with handling, the case stacks cannot exceed a predetermined height. As a result thereof, the magazine capacity is closely correlated with the maximum height of the stack being utilized as it is virtually impossible to position several stacks in the feeding magazine for practical reasons. For example, it has been found that the magazine capacity cannot be of a capacity greater than about 60–80 cases. Considering the production rates of current packaging apparatus, such a threshold capacity enables an automatic operation which requires the loading of a new stack every two minutes.

In many cases, this time limit appears to be insufficient to allow an operator to dispose a new case stack in the feeding magazine when needed. In fact, it often happens that when the two minutes have elapsed, the operator is loading other components such as trays, compact discs, booklets, covers or the like, in one or more of the apparatus work stations.

It is readily apparent that when the cases in the feeding magazine are exhausted, the packaging apparatus will stop production.

It is well-known that prior apparatus for the automatic packaging of compact discs include within their operating cycle insertion of booklets, covers, leaflets or the like into cases designed to receive the compact discs.

Usually feeding of these brochures is achieved with the aid of a belt conveyor by which the brochures are individually positioned close to a pick-up station where, by means of a mechanical handling device, the brochures are picked up to be conveniently fitted into the respective case.

Presently, placement down of the brochures onto the belt conveyor is performed manually by an operator assigned to assist with operation of the packaging machine.

More particularly, the operator, when it is necessary, places a number of brochures stacked on top of each other at the beginning of the longitudinal extension of the belt conveyor. The stacked brochures are distributed in a direction towards the pick-up station so that, when distribution is completed, each brochure projects towards the pick-up station with respect to the next one disposed immediately below.

The belt conveyor is then operated such that the brochures progress towards the pick-up station, until the first brochure in the stack reaches the pickup station.

The belt conveyor is then stopped in response to signals received from photoelectric cells or similar sensing devices positioned in the pick-up station, to thereby enable the handling device to pick up the first brochure. Thereafter, operation of the belt conveyor will be repeated so as to position the next brochure in the stack at the pick-up station.

However, these prior booklet insertion mechanisms have been found to have the following disadvantages.

First, the amount of brochures which can be disposed on the belt is closely related to the longitudinal extension of the belt conveyor. It is therefore difficult to obtain a sufficiently self-contained operation, especially in packaging machines of relatively small sizes, where the belt conveyor length is necessarily restricted. In addition, a correct distribution of the brochures on the belt requires a certain skill level of the operator.

Second, the time required for periodically distributing the brochures on the belt conveyor, because, if an operator is performing this function, the operator will be unable to assist in the other operations of the packaging machine.

It is known that optical discs of the type commercially referred to as "compact discs" and normally used for recording and reproducing sounds and/or images and also for storing data for computers, are generally packaged into cases of transparent plastic material each of which is essentially defined by a housing portion on which a lid portion to be snap-closed is hinged like a book.

More specifically, in one widely used type of case, the compact disc is removably engaged on a so-called "tray" which in turn is mounted by restrained coupling to the housing portion of the case after introducing into the housing portion one leaflet generally including lyrics and/or illustrations (e.g., referring to data or recorded music provided on the compact disc).

A booklet containing further information about the record album and/or the recorded data is also placed in the lid portion. This booklet is engaged with the lid portion by sliding the booklet between the inner surface of the lid portion and appropriate retaining tabs projecting from the inside surface of the lid portion so as to retain the booklet at its opposite edges.

There are several other types of cases distinguishable from the case previously described. For example, in one such prior case, a tray is adapted to receive two compact-discs on its opposite faces, while other cases are completely devoid of the tray.

In cases in which there is no tray, the compact disc is removably engaged on retaining lugs directly formed in the housing portion of the case. In this type of compact disc case, the previously mentioned leaflet and booklet are replaced by a single sheet usually referred to as a "cover". Such a cover is engaged internally of the lid portion by insertion of one of its bent edges in a pocket-like seat formed along the pivot edge of the lid portion on the housing portion.

In order to achieve a finished package compact disc, the required operations for packaging compact discs into the respective cases are usually performed with the aid of automatic apparatus, essentially provided with a plurality of work stations suitably distributed along a feed line.

With such an automatic apparatus, the individual cases are received from a feeding magazine of a case feeding unit and are engaged sequentially by a case separation member which causes the cases to progress stepwise along the feed line.

During this movement along the feed line, each case first encounters an opening station wherein, upon the action of a grasping member provided with a suction cup at an end of appropriate mechanical linkage, the case lid portion is moved, by a 180° overturning, from a closed condition, wherein the lid portion lies upon the housing portion of the case, to an open condition, wherein the lid portion extends in a coplanar relation with the housing portion.

Arranged downstream of the opening station is another work station, where the above-mentioned leaflet is introduced and inserted into the housing portion of the case. To achieve this result, an appropriate leaflet insertion mechanism is provided to receive the individual leaflets from a leaflet collection magazine in which the leaflets are arranged in the form of a stack. Each leaflet is then introduced into the housing portion by the insertion mechanism after the leaflet has been suitably shaped by means of an appropriate bending mold.

Subsequently, the cases are transferred to two further work stations wherein a tray is inserted into the housing portion of each case and then in succession engaged in the case by a restrained coupling. In another work station, one booklet is disposed on the inner face of the case lid portion, and afterwards each case is transferred to a further work station wherein a compact disc is brought into engagement with the tray disposed in the housing portion. Each case along the feed line is finally transferred to a closing station wherein, with the aid of a pusher element operated by an appropriate driving mechanism, the lid portion is moved from the open condition to the closed condition.

In the packaging apparatus of the above-described type, movement of the grasping members and pusher elements located in the opening and closing stations and operation of most of the movable members provided in all of the work stations are achieved by a mechanical transmission.

As a result, since it is necessary to impart a 180° rotation to the lid portion in order to move it between the closed and open conditions, the mechanical linkages for transmitting all of these movements is necessarily of a very complicated structural construction. In addition, these mechanical linkages must operate in a very precise manner in that the compact disc cases are usually made of a plastic material which is easily breakable.

As a result thereof, the mechanical components of the prior compact disc packaging apparatus for opening and closing the cases are themselves very complicated in nature, thereby leading to higher production costs and also enhanced servicing and start-up costs.

In addition, the above-described apparatus of the known art are very bulky and their construction involves high costs because each of the operations provided in the packaging cycle requires the presence of a specific work station along the feed line. Besides the work stations for respectively carrying out the insertion of the leaflets, trays, booklets and compact discs, further work stations must be provided although they are likely to be often inactive. In fact, such stations are equipped with the appropriate devices only in case of need, for example, for performing either the insertion of a second compact disc if trays intended for supporting two compact discs are used, or for the insertion of the so-called "cover" if cases adapted to directly receive the compact discs are used (that is, cases which do not require insertion of the tray, the leaflet and the booklet).

OBJECTS AND SUMMARY OF THE INVENTION

Therefore, it is an object of the present invention to provide a case feeding unit in an automatic apparatus for packaging manufactured articles into cases which avoids the disadvantages noted with respect to the prior art.

It is also an object of the present invention to provide a case feeding unit which conveniently enhances the automatic character of such case feeding units without increasing bulkiness or practical problems attendant to loading new stacks of cases into the feeding unit.

The foregoing and further objects are achieved by a case-feeding unit in an automatic apparatus for packaging manufactured articles into cases of the present invention which includes a feeding magazine having vertical holding walls and arranged to contain a plurality of cases disposed vertically in the form of a stack. A case separation mechanism is also provided in the case-feeding unit of the present invention operating adjacent to a lower end of the feeding magazine to receive the cases sequentially from the stack. A base platform supports a new case stack to be loaded into the feeding magazine. A transferring mechanism operating adjacent to the base platform introduces the new case stack into the feeding magazine by horizontally moving the new stack through an entrance side of the feeding magazine defined between the holding walls. A sensor is associated with the feeding magazine to actuate the transferring mechanism when the height of the stack of the feeding mechanism falls below a predetermined level.

It is another object of the present invention to provide a method and apparatus for feeding brochures, such as booklets, covers or leaflets, to a belt conveyor which avoids the aforementioned disadvantages of the prior art.

An additional object of the present invention is to provide a method and apparatus for feeding brochure to a belt conveyor which enables the brochures to be sequentially fed onto the belt conveyor, by a respective feeding unit of reduced bulkiness, in a completely automatic manner.

The foregoing and further objects are substantially achieved by a unit for individually feeding brochures to a pick-up station which includes a feeding magazine arranged to receive a plurality of brochures disposed consecutively on top of each other in the form of a stack. In the feeding unit of the present invention, at least one of the brochures, disposed in a lowermost position in the stack, is in abutting relation with the belt conveyor such that the lowermost brochure can be withdrawn, upon the action of the conveyor, through an outlet side of the feeding magazine.

At least one locating member is supported above the belt conveyor and defines therewith a gauged passage clearance greater than the nominal thickness of each brochure. The locating member is arranged so as to interfere with the back edge of the brochure to stop progress of the brochure on the belt conveyor.

A presser member is operatively associated with the locating member and is arranged to exert a thrust action on the back edge of the brochure so as to elastically deform the brochure from a free condition, wherein the upper surface of the brochure at its back edge lies at a slightly higher level than a lower end of the locating member, to an elastic-yielding condition, wherein the upper surface of the brochure is positioned under the lower end of the locating member so that the brochure can be moved by the belt conveyor passing under the locating member.

It is another object of the present invention to provide an apparatus for packaging compact discs into respective cases and a method for packaging compact discs into respective cases which avoids the disadvantages of the prior art.

An additional object of the present invention is to provide an apparatus for packaging compact discs into respective cases wherein the opening and closing operations of the case are accomplished in a greatly simplified manner in comparison with the known art.

A further object of the present invention is to provide an apparatus for packaging compact discs into respective cases wherein the cooperation between all of the individual machines necessary for assembling the different components for the finished compact disc case is achieved in relatively few work stations so that the overall dimensions and the production costs of the apparatus as a whole are greatly reduced.

The foregoing and further objects that will become more apparent as a result of the present description are achieved by an apparatus for packaging compact discs into respective cases having stations for opening and closing the lid portion of the case with respect to the housing portion wherein at least one of opening and closing stations comprises at least one air blowing nozzle arranged to direct an air flow against the lid portion in order to cause movement of the lid portion between its closed and open conditions.

Various other objects, advantages and features of the present invention will become readily apparent from the ensuing detailed description, and the novel features will be particularly pointed out in the appended claims.

BRIEF DESCRIPTION OF THE DRAWINGS

The following detailed description, given by way of example, will best be understood in conjunction with the accompanying drawings in which:

FIG. 11 is a side elevational view of the components of an opening station of the apparatus of FIG. 10 for the purpose of opening the lid portion of each case;

FIG. 12 is a side elevational view of the components of the closing station of the apparatus of FIG. 10 for closing the lid portion of each case;

FIG. 13 is a perspective view of one type of compact disc case to be assembled by the packaging apparatus of the present invention; and FIG. 14 is a perspective view of a second type of compact disc case to be assembled by the packaging apparatus of the present invention.

DESCRIPTION OF THE PREFERRED EMBODIMENT

Figure 1:
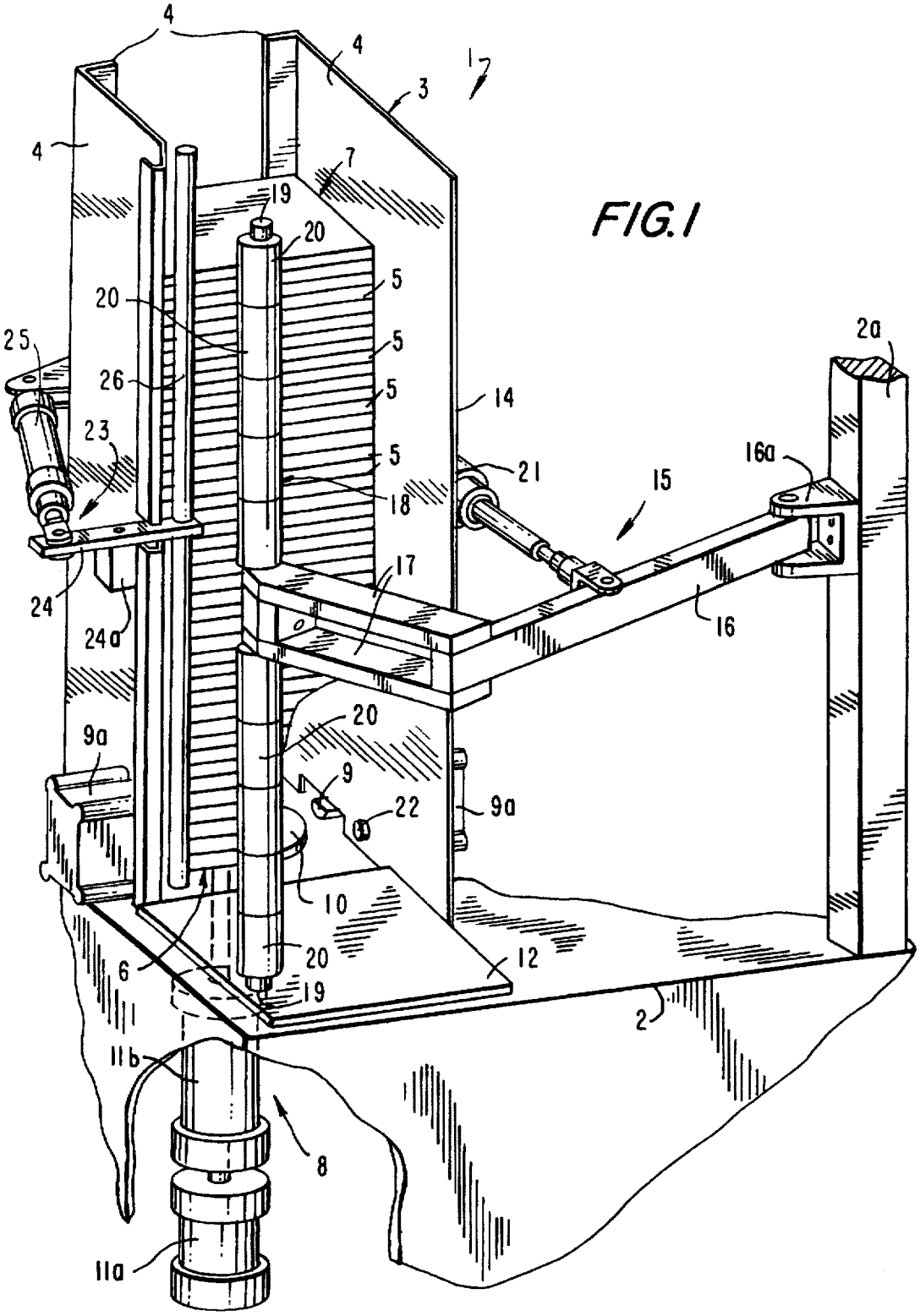
FIG. 1 is a front perspective view illustrating a preferred embodiment of a case feeding unit associated with an apparatus for packaging compact discs into corresponding cases in accordance with the teachings of the present invention.

Referring now to the drawings, wherein like reference numerals are used throughout. FIG. 1 illustrates a preferred embodiment of a case-feeding unit, FIG. 3 illustrates a preferred embodiment of the individual brochure feeding unit, and FIG. 10 illustrates the stations of the apparatus for automatically packaging manufactured articles into cases in accordance with the present invention.

Figure 3:
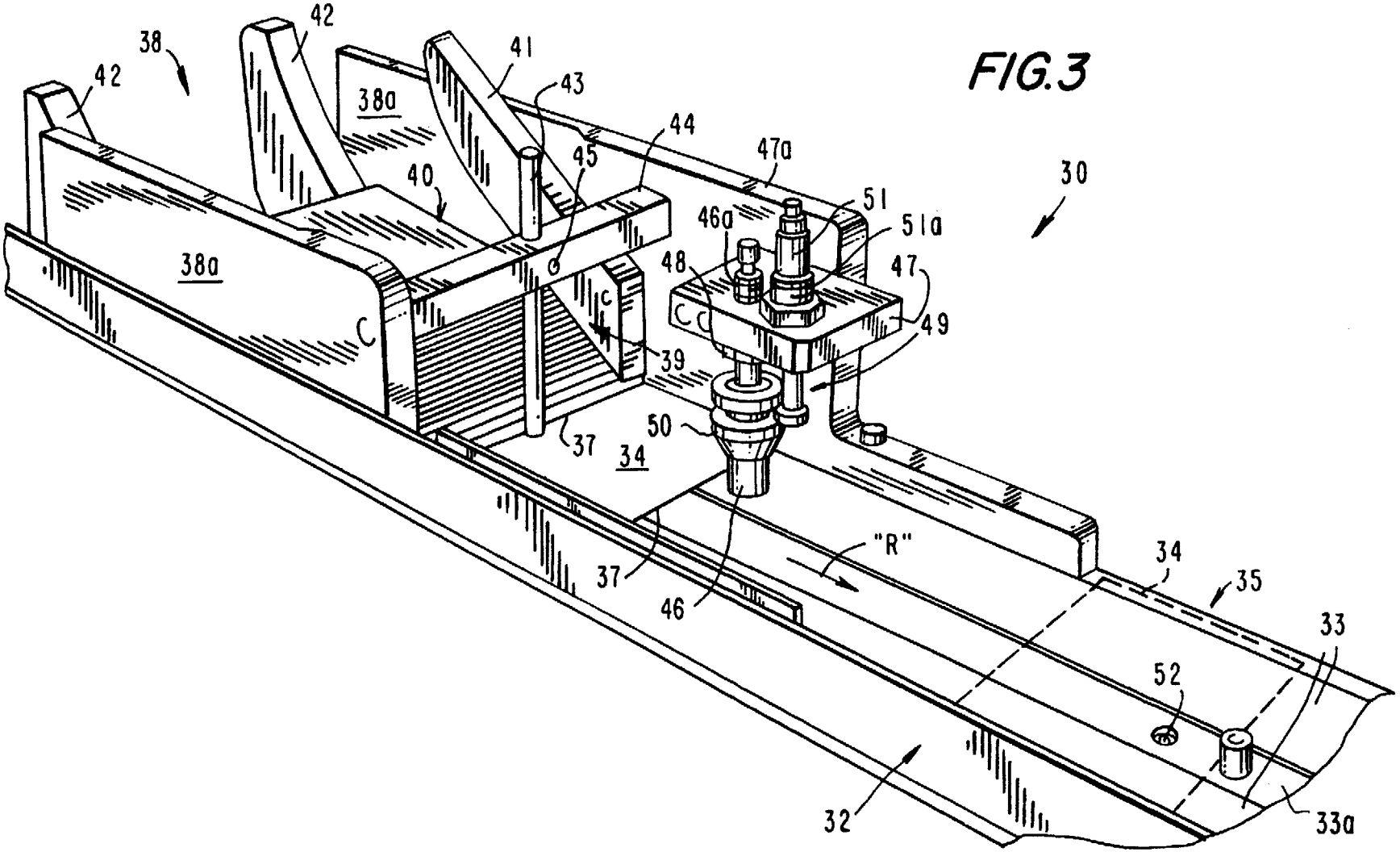
FIG. 3 is a perspective view of a preferred embodiment for a feeding unit for feeding brochures, such as booklets, to a pick-up station in accordance with the teachings of the present invention.
Figure 10:
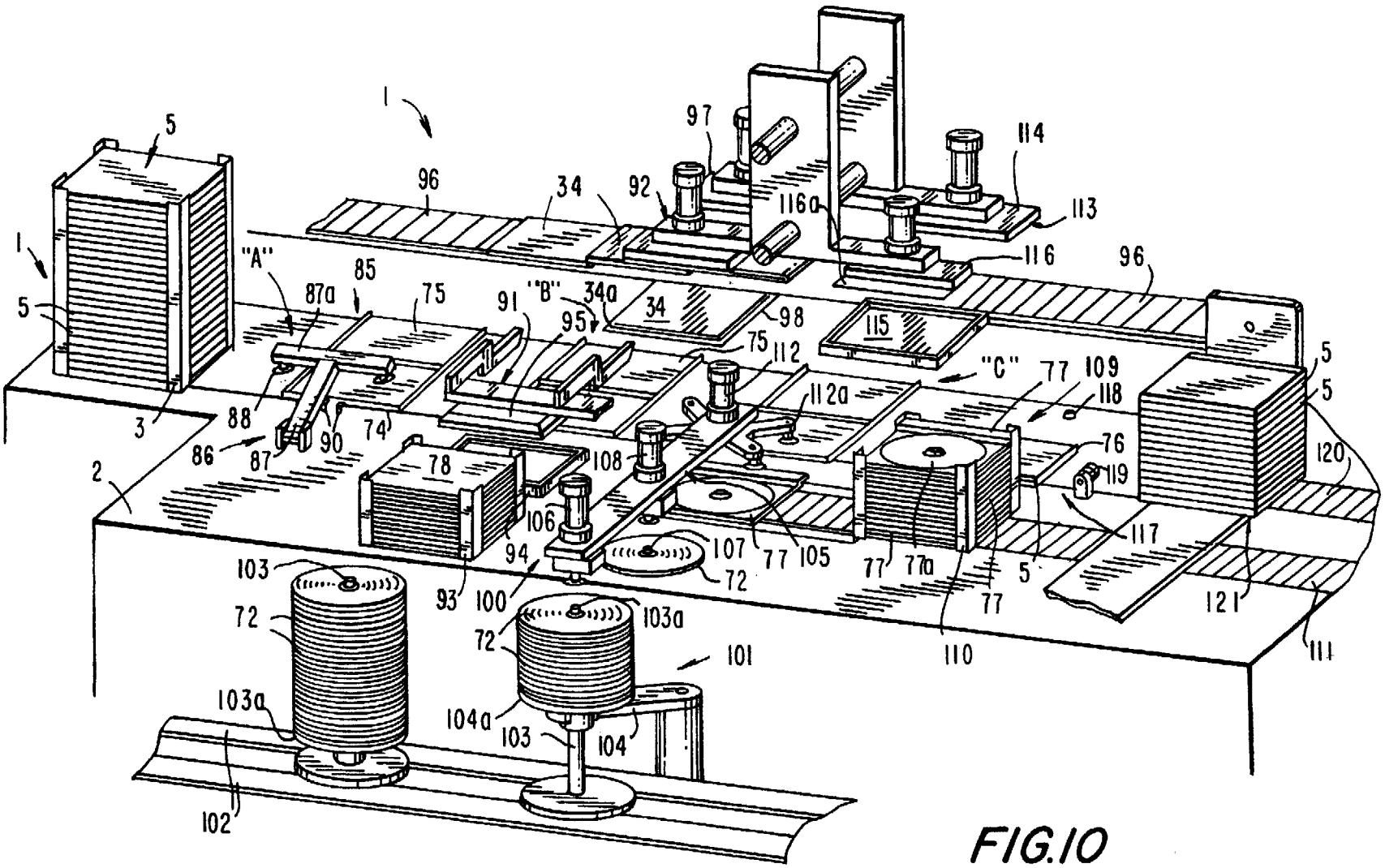
FIG. 10 is a perspective view diagrammatically illustrating a preferred embodiment of an apparatus for packaging compact discs into respective cases in accordance with the teachings of the present invention.

In the embodiment of the case feeding unit illustrated in FIG. 1, the feeding unit 1 is mounted to a bearing framework 2 and is used in conjunction with automatic apparatus for packaging compact discs, shown in FIG. 10 and the brochure feeder shown in FIG. 3 in the system for packaging manufactured articles into cases.

The feeding unit 1 includes a feeding magazine 3 comprising at least three vertical holding walls 4 in a substantially U-shaped profile corresponding to the perimetric shape of the cases 5 which are to be introduced into the magazine through an entrance side 6 defined between the opposite ends of the U-shaped profile (i.e., within the holding walls 4).

The cases 5 contained in the feeding magazine 3 are vertically disposed upon each other in the form of a stack, generally identified by 7, with the bottom case of the stack being removed one by one and conveyed to the different work stations arranged along the packaging apparatus.

As is described below, the bottommost case in the stack is removed from the feeding mechanism by an appropriate case separation mechanism. In the illustrated embodiment, the case separation mechanism 8 generally includes a pair of stop elements 9 disposed at opposite positions at the bottom of the feeding magazine 3. These stop elements 9 are movable, upon command of respective air cylinders 9*a*, towards the inside of the magazine itself to block and support the stack 7 by retaining the lowermost case 5. The case separation mechanism 8 also includes a lifting plate 10 which is disposed under the stack being processed 7 and is vertically movable upon command of respective first and second lifting actuators 11*a*, 11*b* operatively connected in series with respect to each other.

When a case 5 is to be removed from the magazine 3, the case separation mechanism 8 is activated and the lifting plate 10, through the actuation of both lifting actuators 11*a*, 11*b*, is brought into contact relationship with the lower surface of said case. Then, after the case has been released by the stop elements 9, the first lifting actuator 11*a* is actuated to cause the lowering of the lowermost case and the simultaneous descent of the whole stack 7 in the magazine by an amount corresponding to the case height. Then the second lifting actuator 11*b* is actuated in order to separate the case 5 from the stack 7, which stack is retained by the stop elements 9 which are moved inwardly to abut the sides of the new case 5 positioned lowermost in the stack in abutting relationship therewith.

Once the lifting plate 10 has reached its lower stop limit, the case 5 removed from the stack 7 is in a position to be engaged by transporting mechanism (not shown) to be placed in a position to progress step-wise along the packaging apparatus in order to be submitted to the different steps provided for packaging compact discs, discussed below.

In accordance with the present invention, a base element comprising, for example, a loading platform 12 defining a horizontal rest surface is positioned in front of the entrance side 6 of the magazine 3 adjacent to the lower portion of the magazine 3. The loading platform 12 is adapted to receive a new case stack, generally denoted by 13, which is manually placed on the platform.

An abutment wall 14 is formed as an extension of one of the holding walls 4 to provide an abutment surface for the precise alignment of the new stack 13 which is manually placed on the loading platform 12 by the operator.

In addition, a transferring mechanism, generally identified by 15, which operates adjacent to the loading platform 12, is designed to convey the new case stack 13 located on the loading platform to the feeding magazine 3, by horizontally translating or moving the new case stack 13 through the entrance side 6. This transferring mechanism 15 preferably comprises one movement arm 16 hinged about a vertical axis on a bracket 16*a* fastened to a post 2*a* generally vertically supported from the bearing framework 2. The side of the movement arm 16 opposite to the end of the arm hinged to the bracket 16*a*, has a portion extending transversely in cantilevered fashion therefrom, in the direction of the feeding magazine 3.

A pusher member 18 is connected to the free end of the extension portion 17 and is of a vertical height at least equal to the height of the new case stack 13 arranged on the loading platform 12. In particular, the pusher member 18 preferably comprises at least one central support bar 19 supported, at its mid-section of its longitudinal direction, to the free end of the extension portion 17. A plurality of contact rollers 20 are rotatably engaged along the central support bar in a mutually superposed position.

Figure 2:
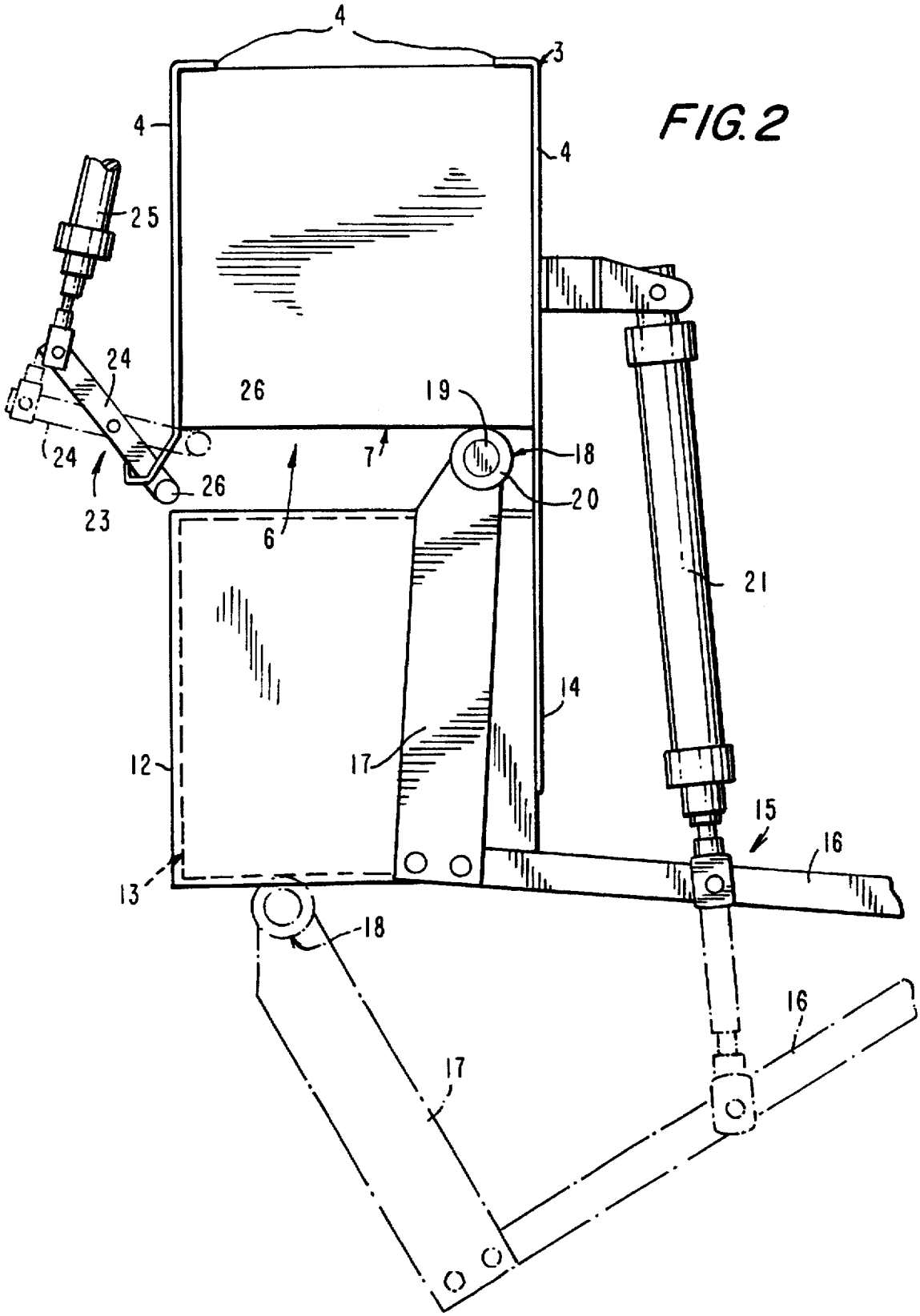
FIG. 2 is a diagrammatic top plan view specifically illustrating the movement of the transferring mechanism and the retaining mechanism of the case feeding unit of FIG. 1.

One fluid-operated actuator 21 acting on the movement arm 16 causes a displacement of the pusher member 18 between a first position, wherein, as shown in FIG. 1 and in dotted line in FIG. 2, the pusher member 18 is spaced apart from the entrance side 6 of the feeding magazine 3, and a second position, wherein, as shown in solid line in FIG. 2, the pusher member 18 is disposed at the entrance side of the magazine to move the new case stack 13 in abutment against the vertical wall 4 of the magazine 3 opposite to the entrance side 6.

Activation of the first fluid-operated actuator 21 occurs upon command of a sensor mechanism comprised for example of photoelectric cells 22 disposed adjacent to a lower portion of the feeding magazine 3. These photoelectric cells actuate the transferring mechanism 15 when the stack 7 in the magazine 3 is exhausted or close to exhaustion. More specifically, when the height of the stack in the magazine, following the progressive removal of cases 5 from the magazine 3, falls below a predetermined level, insertion of the new stack 13 into the magazine 3 will be performed.

Advantageously, the arrangement of the contact rollers 20 on the pusher member 18 eliminates all risks of damage to the cases 5 and/or malfunction when the new stack 13 is being conveyed into the magazine 3 due to the unavoidable relative sliding of the contact point of the pusher member 18 along the sides of cases 5.

The feeding unit further comprises a retaining mechanism 23 selectively movable between a rest condition, wherein the retaining mechanism 23 is spaced apart laterally from the entrance side 6 of the feeding magazine 3 to permit access of the new case stack 13 into the magazine, and an operating condition, wherein the retaining mechanism is moved adjacent to the entrance side 6 to stabilize the positioning of the stack 7 being processed within the feeding magazine. More particularly, the retaining mechanism 23 preferably comprises at least one auxiliary arm 24 connected, about a vertical axis, to a corresponding engagement bracket 24*a* secured remote from the feeding magazine 3. The auxiliary arm 24 is movable about a corresponding hinging point upon command of an auxiliary actuator 25. A vertical abutment bar 26 is provided at an end of the auxiliary arm 24 which, following operation of the auxiliary actuator, is selectively moved between a start position, wherein, as shown in solid line in FIG. 2, the abutment bar 26 is laterally moved away from the feeding magazine, thereby enabling access of the new stack 13 through the entrance side 6, and a work position, wherein, as shown in dotted line in FIG. 2, the abutment bar 26 is moved in abutment relation with respect to the stack 7 contained in the feeding magazine thereby assisting in stably positioning the stack 7 within the magazine. In this manner, the risk that one or more cases 5 may slip upon each other and be inadvertently removed from the magazine through the entrance side 6 thereof is substantially eliminated.

Operation of the above-described feeding unit is as follows.

When the packaging apparatus is operating in a normal manner, the case separation mechanism 8 removes the individual cases 5 from the stack 7 in the magazine, and in turn, the height of the stack will progressively decrease. During this step, the abutment bar 26 is maintained in its work position, the pusher member 18 is held in its first position spaced from the entrance side of the magazine, and a new stack 13 can be manually placed on the loading platform 12.

When the cases 5 within the magazine 5 are exhausted, or when the height of the stack in the magazine falls below a predetermined level, the photoelectric cells 22 cause the activation of the auxiliary actuator 25 to thereby move the abutment bar 26 to its start position, and also activate the first fluid-operated actuator 21 to displace the pusher member 18 towards the second work position adjacent to the entrance side of the magazine. Consequently, the new case stack 13 will be moved horizontally through the entrance side 6 and, as a result thereof, introduced into the feeding magazine 3 to enable removal of the individual cases 5 by the case separation mechanism 8.

In the embodiment described, in which activation of the first fluid-operated actuator 21 occurs when the stack 7 is exhausted or the height of the stack falls below a predetermined level, the lifting plate 10 during the transferring step of the new stack 13 is maintained in a raised position substantially flush with the loading platform 12 to slidably support the new stack 13 which is being pushed into the magazine 3 by the pusher member 18.

When transferring of the new stack 13 into the magazine has been completed, the abutment bar 26 is returned to its work position and the pusher member 18 is brought to its first work position remote from the entrance side of the magazine, to enable arrangement of a new case stack 13 on the loading platform 12.

As a result of the design of the present invention, this case feeding unit has an automatic feeding operation which lasts twice as long as compared with the conventional case feeding units. Therefore, the present case feeding unit alleviates the problems associated with repeated stoppage of the production line when the cases in the feeding magazine are exhausted and the operator is not ready to supply the magazine with a new stack of cases.

In fact, the present invention enables the operator to arrange a new stack of cases on the loading platform as soon as a stack being processed has been introduced into the feeding magazine.

As a result, the maximum lapse of time that may pass between the loading of two new consecutive stacks in the magazine includes the time during which the new case stack is positioned on the loading platform as well as the time during which this case stack, after being transferred to the magazine following exhaustion of the preceding case stack, is exhausted.

It will be also recognized that the feeding unit of the present invention does not cause any significant increase in the bulkiness of the case feeding unit as compared to the prior case feeding units. In fact, the duration of automatic operation which lasts twice as long as conventional case feeding units is achieved by utilizing the space in front of the entrance side of the feeding magazine for positioning the loading platform and transferring mechanism. This space was necessary in prior case feeding units as well in order to enable the manual introduction of case stacks through the entrance side by the operator.

The aspect of the CD packaging machine for feeding brochures, leaflets, etc. to various stations of the apparatus shown in FIG. 10 is described below.

FIG. 3 illustrates a preferred embodiment of a unit for individually feeding brochures onto a belt conveyor in accordance with the present invention, which has been generally identified by reference numeral 30.

The feeding unit 30 includes a belt conveyor 32 which, in the embodiment shown, is used in conjunction with a machine for automatically packaging compact discs. This feeding unit 30 individually transfers brochures 34 to a pick-up station 35, wherein brochure 34 is picked up by a handling device of the packaging machine, as shown in FIG. 10 and described hereinbelow.

The belt conveyor 32 includes one or more parallel endless belts 33 usually moved along a slide surface 3*a* according to a feed direction shown by arrow "R".

Figure 4:
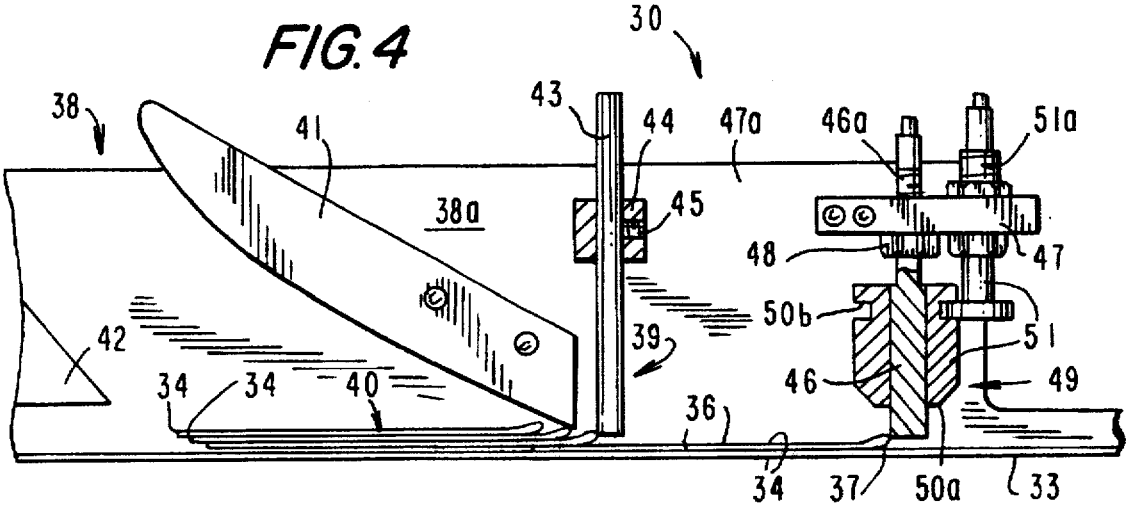
FIG. 4 is a side sectional view of the feeding unit of FIG. 3 specifically illustrating stoppage of a brochure against a locating member arranged on the belt conveyor, downstream of a feeding magazine.
Figure 5:
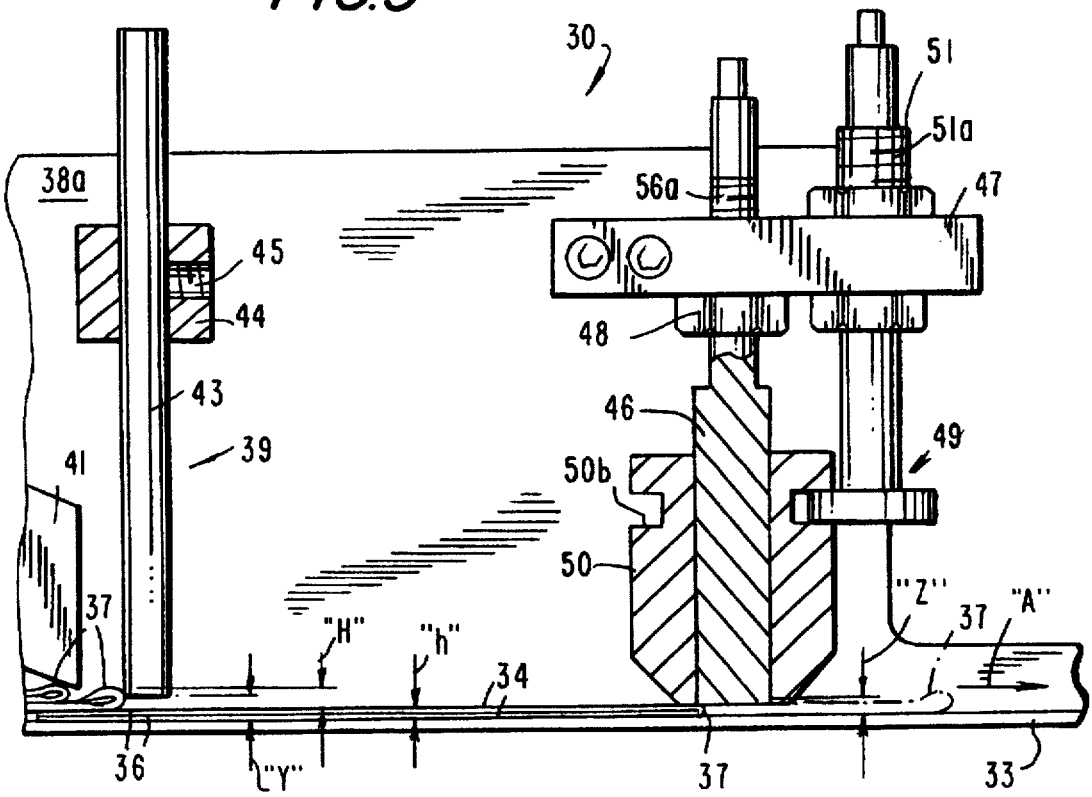
FIG. 5 is an enlarged side sectional view of the right-hand portion of the feeding unit of FIG. 4 specifically illustrating a pusher element associated with the locating member in an operating condition acting on the back edge of a brochure to enable passage of the brochure under the locating member.

In the embodiment illustrated in FIGS. 3 to 5, the unit 30 is arranged so as to be utilized in conjunction with brochures 34, such as booklets. In this case, each brochure 34 has at least two pages 36 disposed upon each other in mating relationship so that at least one sheet folded along a back edge 37 is oriented in the feed direction "R" (see FIGS. 5 and 6). Due to residual elasticity of the material forming the sheet, when the back edge is folded, the pages 36 at the back edge are not perfectly coupled against each other. Instead, at the back edge thereof, the pages 36 are slightly spaced apart.

Therefore, when a brochure 34 is in a free condition (that is, in the absence of external stresses, the pages 36 perfectly mate at the back edge 37 thereof), the height "H" (see FIG. 5) close to the back edge is greater than the nominal thickness "h", which is the sum of the page thicknesses when the pages 36 perfectly mate.

The feeding unit 30 is also provided with a feeding magazine 38 mounted on the belt conveyor 32 which includes at least two housing side walls 38*a* between which an outlet side 39 is defined, which is oriented in the feed direction "R" of the conveyor. The magazine 38 houses a plurality of brochures 34 having the respective back edges 37 facing the outlet side 39. In the magazine 38, the brochures 34 are consecutively placed on top of each other to form a stack generally denoted by 40. At least the lowermost brochure 34 in the stack 40 is directly in abutment with respect to the endless belts 33 of the belt conveyor 32 and therefore can be withdrawn from the magazine through the outlet side 39 upon operation of the belt conveyor.

Preferably, one or more guide elements 41 are fastened to the inner surfaces of the housing walls 38*a* of the magazine 38 and act on the upper part of the opposite side edges of the brochures 34 so as to obtain a curvilinear and/or substantially inclined orientation of the stack 40 in the magazine 38. This inclined orientation causes each brochure 34 to be slightly projected towards the outlet side 39 of the magazine 38 relative to the next brochure 34 placed immediately on top of it. The action of the guide element or elements 41 may be assisted advantageously by one or more auxiliary guide elements 42 adapted to act on the lower surfaces of the brochures' side edges.

Advantageously, at least one partition element 43 is operatively supported at the outlet side 39. The partition element 43 is formed of a rod passing through and removably fastened, according to a substantially vertical axis, to a horizontal support bar 44 secured between the housing walls 38*a* of the feeding magazine 38. Associated with the partitionelement or rod 43 is a positioning member which in the illustrated embodiment of FIG. 3 is in the form of a headless screw 45 operatively engaged through the support bar 44. This positioning member allows for the modification of the axial positioning of the rod so as to suitably adjust the width of an outlet port "Y" (see FIG. 5) defined between the lower end of the partition rod 43 and the belt conveyor surface, and more particularly, the endless belts 33 of the belt conveyor 32.

The width adjustment of the outlet port "Y" attempts to allow only a predetermined number of brochures 34 to simultaneously pass through the outlet side 39. More particularly, the width of this outlet port "Y" is preferably adjusted by an amount substantially corresponding to the height "H" at the back edge 37 of each brochure 34 in the free condition, so as to hinder the simultaneous passage of more than one brochure under the partition rod 43.

Downstream of the feeding magazine 38 along the belt conveyor and preferably at a distance "D" lower than the longitudinal dimension "L" of each brochure 34 is provided at least one locating member 46. The locating member 46 is supported above the belt conveyor 32 and is arranged to interfere with the back edge 37 of the brochure 34 emerging from the feeding magazine 38, to stop progress of that brochure on along the belt conveyor 32. Accordingly, when the back edge of each brochure encounters the locating member 46, the corresponding brochure 34 will be stopped and, since operation of the belt conveyor 32 continues, the endless belts 33 slide under the brochure.

More specifically, the locating member 46 substantially includes a rod-like element which is operatively connected, according to a substantially vertical axis, to a support bracket 47 formed integrally with the belt conveyor 32. In the embodiment shown in the figures, the support bracket 47 is rigidly linked to an extension 47*a* of one of the housing walls 38*a* of the feeding magazine 38.

Operatively associated with the rod-like locator 46 is an adjusting member for adjusting the distance between the lower end 46*b* of the locator and the belt conveyor 32. In a preferred embodiment, this adjusting member is formed of a threaded portion 46*a* disposed on the rod-like element forming the locator 46 and operating in engagement through the support bracket 47. Therefore, by rotating the rod-like element 46, the axial positioning of the rod-like element can be modified so that its lower end 46*b* can be moved close to or away from the belt conveyor 32.

Advantageously, the axial positioning of the rod-like element 46 is adjusted such that, between the lower end 46*b* of the rod-like element and the belt conveyor 32 (and more particularly, the work surface 33*b* of one of the endless belts 33) a gauged passage clearance "Z" is created (see FIG. 5). The width of the gauged passage clearance "Z" is greater than the nominal thickness "h" and preferably the width "Z" is between the thickness "h" and twice the thickness "h".

In addition, the width of the gauged clearance "Z" is set to be smaller than the height "H" (the height close to the back edge 37 of each brochure 34 in a free condition), to ensure that movement of each brochure 34 is stopped by the locating member 46.

Once the desired adjustment of the gauged clearance "Z" has been achieved, a locking nut 48 operatively fitted on the threaded portion 46*a* enables locking of the locating member.

Still in accordance with the present invention, operatively associated with the locating member 46 is a presser member 49 selectively operable to exert a thrust action against the back edge 37 of the brochure 34 while the brochure is stationary against the locating member. This presser member 49 preferably includes at least one pusher element 50 slidably guided along the rod-like element 46 which is selectively movable between a rest position, wherein the pusher element 50 is raised from the brochure 34 (see FIGS. 3 and 4), and an operating condition, wherein the pusher element 50 acts in thrust relation on the brochure back edge 37 (see FIG. 5).

When the pusher element 50 is in its operating condition, the thrust action exerted by it on the back edge 37 of the brochure 34 causes the simultaneous compaction of the pages 36 in the vicinity of the back edge. As a result thereof, the brochure 34 attains to a yielding condition in which the height at the back edge 37 is substantially identical with the nominal thickness "h", and in any case, is lower than the dimension of the gauged passage clearance "Z". In this yielding condition, the upper surface of the brochure 34 is positioned below the lower end 46*b* of the locating member 46 and the brochure is allowed to pass under the locating member 46, as a result of the dragging action exerted by the belt conveyor 32.

Preferably, the pusher element 50 has a cylindrical configuration with a tapered lower end, so that its end portion 50*a* of reduced size impinges upon the brochure 34, which ensures concentration of the thrust force on the back edge 37.

In addition and for the purposes of ensuring a correct dragging of the brochure 34 by the belt conveyor 32, the pusher element 50 is at least partly made of a material that when in contact with the brochure 34, provides a friction coefficient lower than that generated by the belt conveyor, and more particularly, the endless belts 33 of the belt conveyor.

Movement of the pusher element 50 occurs in response to the command of at least one fluid-operated actuator or another type of actuator 51 that, in a preferred embodiment, is actuated upon command of at least one photoelectric cell 52 or equivalent sensing device arranged in the pick-up station 35. This enables the transfer of a new brochure 34 to the pick-up station when the brochure previously disposed therein has been picked up by the handling device associated with the packaging machine.

In the embodiment shown, the fluid-operated actuator 51 is disposed in side-by-side relation with the locating member 46 and acts on the pusher element 50 at an annular groove **50*b* formed peripherally in the pusher element 50. Actuator 51 also has a threaded portion 51*a* which is operatively engaged through the support bracket 47. Therefore, the axial positioning of the actuator 51 can be modified by rotating it so as to adjust positioning of the pusher element 50 in its operating condition. Preferably, the adjustment occurs in such a manner that, in its operating condition, the pusher element 50 is stopped with its work portion 50*a* substantially flush with the lower end of the locating member 46, so as to prevent an undesirable large thrust force from being applied to the brochure 34**.

The pusher element 50 is also capable of performing its function in an efficient manner in the event that two or more superimposed brochures 34 stop against the locating member 46. In fact, even if the pusher element 50 stops its stroke in its operating condition against the uppermost brochure 34, its thrust action will always be transmitted to the back edge 37 of the brochure 34 disposed on, and in direct contact with the belt conveyor 32. As such, the brochure in direct contact with the belt conveyor will consequently achieve a compacting condition.

Figure 7:
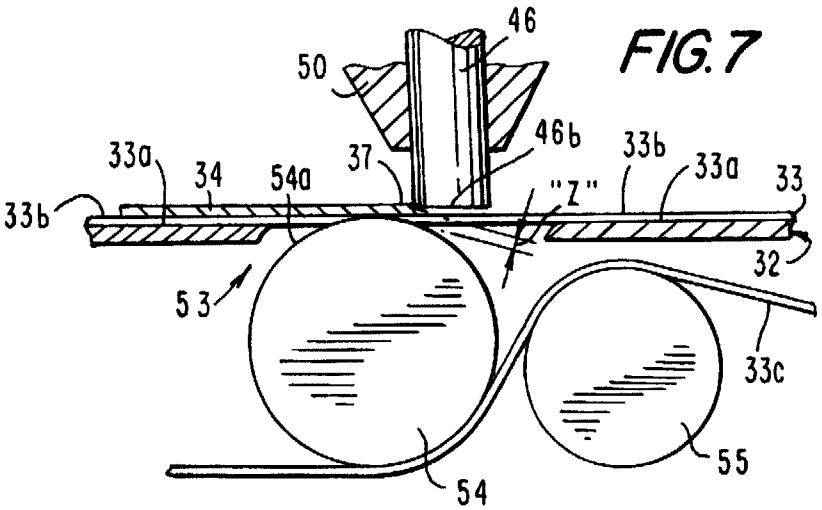
FIG. 7 is a partial enlarged side elevational view in section of the feeding unit of FIG. 6, specifically illustrating stoppage of a brochure against the locating member.
Figure 8:
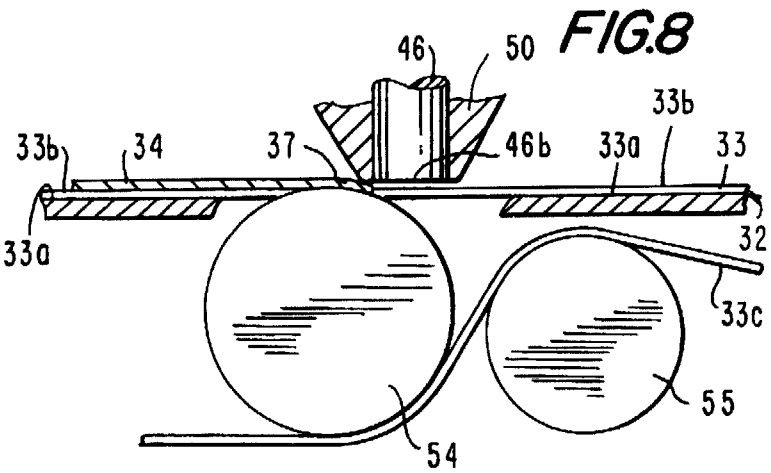
FIG. 8 is a partial enlarged side elevational view in section similar to the view of FIG. 7, specifically illustrating an operating condition in which the pusher element places the brochure at a position allowing for passage of the brochure under the locating member.
Figure 6:
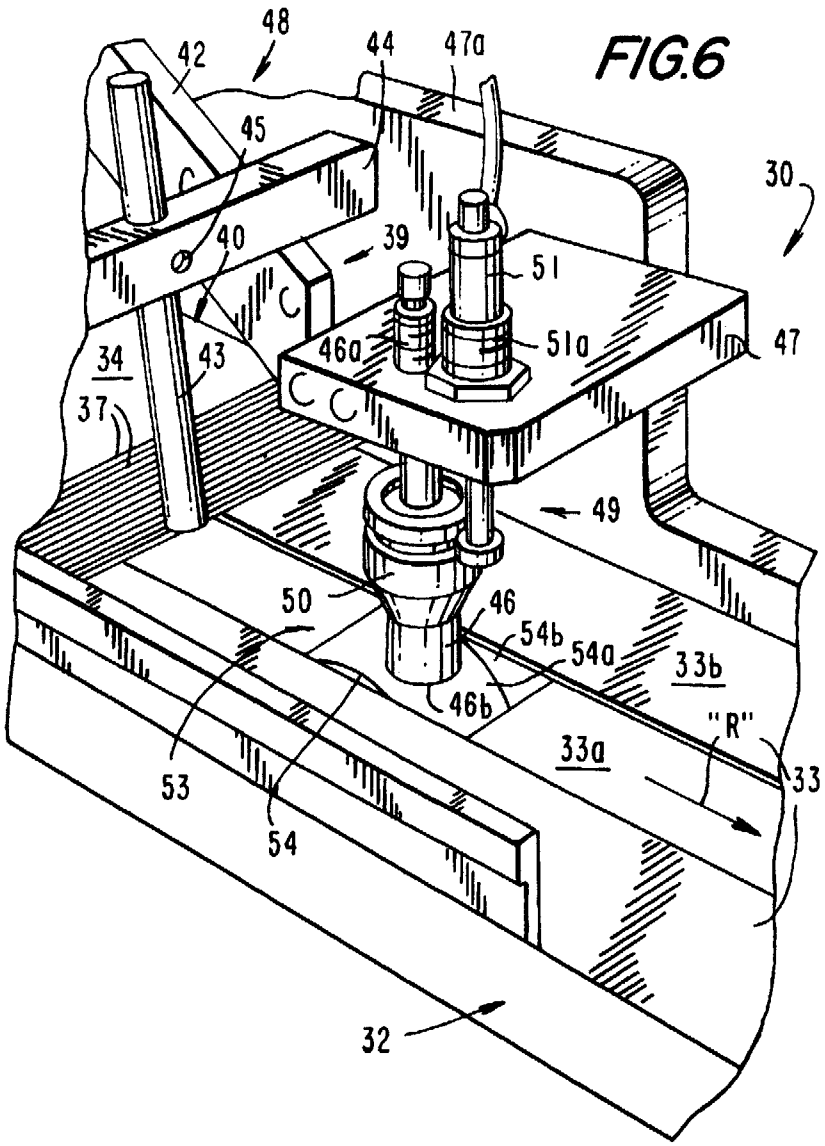
FIG. 6 is a partial front perspective view of another preferred embodiment of a feeding unit adapted to feed brochures, such as booklets, cover, or leaflets, to a pick-up station in accordance with the teachings of the present invention.

Referring now to FIGS. 6 through 8, another embodiment of a feeding unit in accordance with the teachings of the present invention adapted to perform feeding of brochures 34, such as booklets, covers or individual leaflets, is illustrated.

In the embodiment of FIGS. 6 through 8, a leveling member 53 associated with the belt conveyor 32 is arranged close to the locating member 46 to retain the back edge 37 of the brochure 34 slightly raised relative to the lower end **46*b* of the locating member. As a result of this leveling member 53, the brochure 34 emerging from the feeding magazine 38 is conveniently supported by the endless belts 33 such that the respective work surfaces 33*b* are at a slightly higher level than the slide surface 33*a*. The locating member 46, instead of operating above one of the belts 33 (as in the embodiment of FIGS. 3 to 5) is disposed in alignment with the slide surface 33*a*. As a result, its lower end 46*b* can be positioned to a level slightly underneath the work surfaces 33*b* of the belts 33 in order to efficiently engage or block the back edge 37 of the brochure 34** regardless of whether the brochure is a cover or an individual leaflet.

Preferably, at least one dragging roller 54 is also provided which is operatively disposed between the endless belts, according to an axis perpendicular to the feed direction "R".

Particularly, the roller 54 at its opposite ends has terminal portions **54*b* acting on the belts 33 and in contact relationship therewith so that the roller rotates upon operation of the belt conveyor 32. As shown in FIGS. 7 and 8, on the return stretches 33*c* of the belts 33, at least one pressure roller 55 may be arranged so as to ensure engagement of the return stretches with the dragging roller 54** in a wrapping arc orientation sufficient to ensure an efficient driving of the belts upon rotation of the roller.

In the region between the endless belts 33, the dragging roller 54 is provided with an operating surface **24*a* which acts on the pusher element 50 in opposite relationship therewith so as to facilitate dragging of the brochure 34** when the latter is in its yielding condition upon the action of the pusher element.

Advantageously, the operating surface **54*a* of the dragging roller 54 slightly projects on the upper side relative to the slide surface 33*a*, so as to assist or take the place of the endless belts 33 as a result of the leveling member 53, that is, to slightly raise the back edge 37 of the brochure 34 relative to the lower end 46*b* of the locating member 46**.

As is best shown in FIGS. 7 and 8, the brochure 34 (either in the form of an individual leaflet, or in the form of a cover or a booklet) removed from the feeding magazine 38 stops against the locating member 46, with its back edge 37, in the middle portion of its extension, slightly raised from the underlying surface of the dragging roller 54. When the photoelectric cell 52 causes the fluid-operated actuator 51 to displace the pusher element 50 to its operating condition, the back edge 37 is elastically deformed such that the upper surface of the brochure 34 is positioned under the lower end **46*b* of the locating member 46. Due to the effect of the endless belts 33 and the dragging roller 54, the brochure 34 has the possibility of being dragged along through the passage clearance "Z" defined between the lower end 46*b* of the locating member 46 and the operating surface 54*a*** of the dragging roller.

In this event as well, accumulation of two or more superposed brochures 34 against the locating member 46 does not cause malfunctions of the feeding unit 30, because the action of the pusher element 50 will always be transmitted to the brochure 34 located in the lowermost position, ensuring passage of the same through the gauged clearance "Z".

Figure 9:
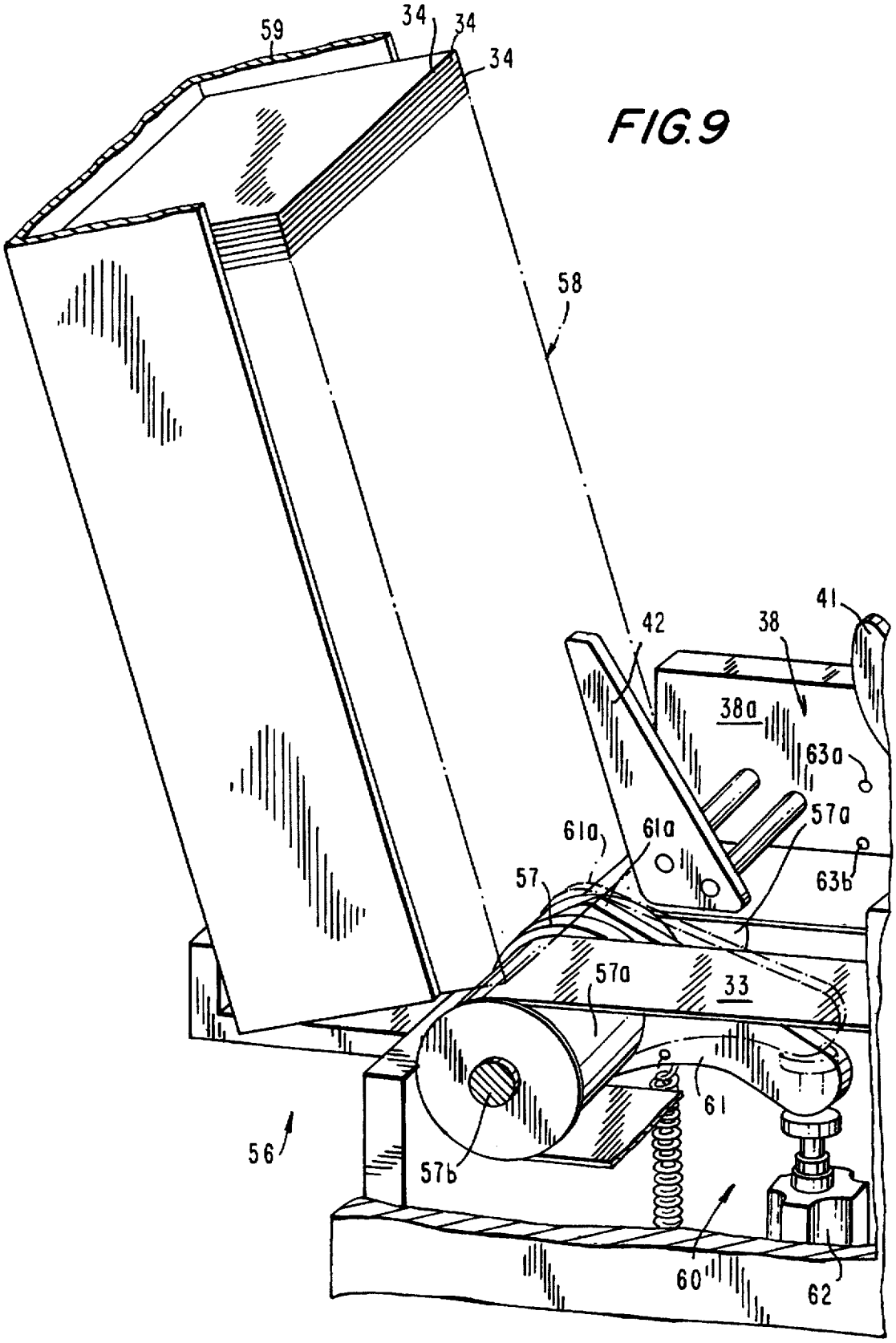
FIG. 9 is a front perspective view of a preferred embodiment of an auxiliary feeder to be optionally used in conjunction with the feeding unit of the present invention.

As is best shown in FIG. 9, an auxiliary feeder 56 may advantageously be associated with the feeding unit 30 for periodically supplying the feeding magazine 38 with a new stack 40 of brochures 34.

This auxiliary feeder 56 includes at least one extraction wheel 57 operatively disposed upstream of the feeding magazine 38 and operable in rotation according to a horizontal axis perpendicular to the feed direction "R". In a preferred embodiment, the extraction wheel 57 is advantageously comprised of one or more diametrical expansions formed on respective idler pulleys **57*a* coaxial with each other which are typically arranged at the end of the belt conveyor 32 to conveniently support and guide the endless belts 33. Concurrently with operation of the belt conveyor 32, dragging induced on the idler pulleys 57*a* by the endless belts 33 therefore causes rotation of the extraction wheel 54** at a peripheral speed greater than the movement speed of the belts themselves.

A stack 58 of brochures 34 stacked on top of each other and contained in a brochure holder or supply receptacle 59 is arranged on the extraction wheel 57. This brochure holder 59 extends in a substantially vertical direction, slightly inclined in a direction opposite to the feed direction "R". The brochure holder 59 may advantageously be formed of a box-shaped casing of the type usually used for transporting brochures 34, with an open side at its lower part thereof through which the extraction wheel 57 comes into contact with the lowermost brochure in the stack 58 of brochures 34.

As a result, upon rotation of the extraction wheel 57, the brochure 34 in contact therewith will be removed from the brochure holder 59 and thereby transferred to the feeding magazine 38.

Before the brochure 34 has completely left the brochure holder 59, a new brochure 34 comes into contact with the extraction wheel 57 and therefore begins to be removed as well from the holder. As a result thereof and also as a result of the lower displacement speed of the endless belts 33 relative to the peripheral speed of the extraction wheel 57, the brochures 34 are removed rapidly in succession from the holder 59 and laid down on the endless belts 33 on top of each other. In this manner the brochures 34 pile up against the partition element 43 thereby forming the stack 40 within the feeding magazine 38.

A shutoff mechanism 60 is provided to disable the dragging action of the extraction wheel 57 when a predetermined number of brochures 34 are present in the feeding magazine 38. The shutoff mechanism 60 also restores the dragging action when the magazine is depleted of brochures or the number of brochures falls below a preset level.

The shutoff member 60 is preferably comprised of at least one lifting lever 61 interposed between the idler pulleys **57*a* and is oscillatably engaged on a support axis 57*b* rotatably carrying the pulleys. An air cylinder 62 or similar means acts on the lifting lever 61 to selectively move the lever 61 between a rest position, wherein its work portion 61*a* is spaced apart from the brochures 34 housed in the brochure holder 59, and an operating position, wherein the work portion 61*a* acts on the lowermost brochure 34 in the stack 58 to maintain it in a position slightly raised from the extraction wheel 57 so that the wheel 57 can rotate freely without feeding any brochures to the magazine 38**.

The air cylinder 52 acts in response to first and second photoelectric cells **53*a*, 53*b* or equivalent drive means associated with the feeding magazine 38 to operatively move the lifting level 61 to its rest or work positions respectively, when the height of the stack 40** is above or falls below a preset value.

In accordance with one of the general objects of the present invention, a method for feeding brochures to a pick-up station of the apparatus for packaging manufactured articles in cases, shown in FIG. 10, is also provided by the feeding unit 30 of the present invention. A description of this method follows.

The auxiliary feeder 56 or, in the absence of an auxiliary feeder, an operator assigned to assist in the operation of the packaging machine, supplies the feeding magazine 38 with a stack 40 of brochures 34, when required. By virtue of the presence of the guide elements 41, 42, the stack 40 is arranged in a substantially inclined or stepped configuration with the back side of each brochure 34 projecting towards the outlet side 39 of the magazine 38 relative to the immediately overlying brochure 34. The lowermost brochure 34 in the stack 40 is in abutting relationship with the belt conveyor 32, and more particularly, with the endless belts 33 of the conveyor so that it is ready to be dispensed through the outlet side 39 of the feeding magazine 38 upon movement of the conveyor. While one brochure 34 is being dispensed from the magazine 38, the brochures disposed on top of it are conveniently retained in the magazine by the partition element 43.

Before the removal of the brochure 34 through the outlet side 39 has been completed, movement of the brochure being removed is stopped against the locating member 46. The brochure 34 remains stationary against the locating member 46 until a signal is received from the photoelectric cell 52 that no brochure is present in the pick-up station 35, and as a consequence thereof, the fluid-operated actuator 51 is actuated. Following actuation of the actuator 51, the pusher element 50 exerts a thrust action on the back edge 37 of the brochure 34 such that the brochure achieves its yielding condition so that the brochure can be moved by the belt conveyor 32 passing under the locating member 46.

Operation of the conveyor belt 32 simultaneously causes the removal of a new brochure 34 from the feeding magazine 38 and stoppage of the same at the above-described stationary position against the locating member 46.

When the brochure 34 from the locating member 46 reaches the pick-up station 35, the belt conveyor 32 will be de-activated until the brochure is received by the handling device.

The present invention attains its intended purposes.

As a result of the design of the present invention, the feeding unit enables feeding of brochures onto a belt conveyor to be achieved in a completely automatic manner, which advantageously reduces the longitudinal extension of the conveyor in comparison to the known embodiments wherein brochure distribution along the conveyor belt was executed manually.

The invention therefore enables problems relating to a self-contained operation of the brochure-feeding devices to be alleviated. Those problems were predominant in packaging machines of relatively small sizes that, due to obvious bulkiness reasons, could not have a belt conveyor of a significant longitudinal extension.

The feeding unit of the present invention can also be readily adapted for use with brochures in a variety of forms, such as covers, leaflets or booklets, having a different number of pages and/or different thicknesses, by merely adjusting the width of the gauged passage clearance "Z" and the outlet port "Y".

The main body of the apparatus for packaging manufactured articles into cases, including the individual work stations, is described below.

In FIG. 10, this packaging apparatus has been generally identified by reference numeral 70 and is intended for selectively packaging compact discs 72 into two different types of cases 5.

The first type of case 5, as best shown in FIG. 13, comprises a housing portion 74 and a lid portion 75 made of transparent plastic material which are rotatably connected to each other at a common hinging side 76.

In the case 5 of FIG. 13, a tray 77 is fitted by restrained coupling in the housing portion 74. This tray 77 is provided with at least one engagement seat **77*a* for receiving a compact disc 72. A leaflet 78 reproducing lyrics and/or images referring to the data or the recorded music contained in the compact disc is interposed between the tray 77 and the inner surfaces of the housing portion 74**.

Further information is contained in a booklet 34 positioned on the inner surface of the lid portion 76. This booklet 34 is secured to the inner surface of the lid portion 76 by means of tabs and/or other retaining lugs 80 for maintaining the booklet conveniently in place.

A second type of case 5 is specifically illustrated in FIG. 14. In the case 5 of FIG. 14, the engagement seat **77*a* for the compact disc 72 is of a one piece construction with the inner surfaces of the housing portion 74. This type of case 5 is therefore devoid of the tray 77 and the above-mentioned leaflet 78 and booklet 34 are replaced by a single cover 81 having a U-shaped/bent end border 81*a*. This border 81*a* is inserted in a pocket-like seating 82 formed on the hinging side 76 of the lid portion 75**.

As shown in FIG. 10, the packaging apparatus 70 of the present invention comprises a bearing framework 2 on which a case-feeding unit 1 is operatively mounted, as shown in FIG. 1. The case-feeding unit 1 cyclically transfers the individual cases 5 to the feed line, as indicated marked by arrow "A" in FIG. 10 which is provided on the bearing framework. For clarity purposes, as shown in FIG. 10, this feeding unit includes a feeding magazine 3 containing a predetermined number of empty cases 5 disposed consecutively so as to form a stack. The cases are individually removed from the bottom of the magazine as discussed above and are thereafter transferred to the feed line "A".

A conveying mechanism (not shown) is provided to move the cases in a stepped, sequential motion along the feed line "A".

During this movement along the feed line "A", each case 5 first encounters an opening station, generally denoted by 85, wherein the lid portion 75 is opened with respect to the housing portion 74. As shown in FIG. 10, the opening station 85 included a lifting mechanism 86 preferably having at least one driving arm 87 rotatably mounted about a horizontal axis of the bearing framework 2. As best shown in FIG. 11, this driving arm 87 has an end portion 87*a* on which one or more grasping members are mounted. These grasping members are preferably in the form of suction cup elements 88 provided with respective bellows-like portions 88*a* so that the suction cup elements are fastened to the end portion 87*a* of arm 87.

Upon the actuation of a fluid-operated actuator (not shown), this driving arm 87 is oscillatably movable about an axis parallel to the hinging side 76 of the case between a rest condition, wherein, as shown in dotted line in FIG. 11, the end portion 87*a* of the arm 87 is spaced away from the case 5 positioned on the feed line "A", and an operating position, wherein the suction cup elements 88 engages the lid portion 75 of the case. Once the driving arm 87 has reached its operating position, a suction action is created by the suction cup elements 88 so that, as a result of the resulting axial deformation of the suction cup elements at the bellows-like portions 88*a*, the lid portion 75 is moved from a closed condition, wherein the lid portion lies upon the housing portion 74, to a half-closed condition, wherein the lid portion 75 is slightly separated from the housing portion 74. In this half-closed condition, a restricted opening 89 is defined between the lid portion 75 edge and the edge of the housing portion 74 opposite to the hinging side 76 of the case.

The retaining force of the suction cup elements 88 lifting the lid portion 75 can be assisted advantageously by utilizing one or more auxiliary suction cups (not shown) fastened to the bearing framework 2 along the feed line "A" which provide a suction force to the lower surface of the housing portion 74 to stably fix the positioning of the housing portion before the lid portion is subjected to the suction cup elements 88 to move the lid portion to the half-closed condition. These auxiliary suction cups can be connected to a respective circuit for creating a vacuum therein (not shown).

At least one air flow nozzle 90 is provided in the opening station 85 oriented inwardly toward the small opening 89 to direct an air flow against the inner surface of the lid portion 75. Upon the force applied to the lid portion as a result of this air flow, the lid portion 75 is advantageously rotated and is moved from the half-closed condition to an open condition wherein the lid portion 75 extends in coplanar relation with the housing portion 74. Rotation of the lid portion 75 occurs after the suction cup elements 88 have been deactivated and the driving arm 87 is moved towards its rest condition. The progressive removal of the suction cup elements 88 from the lid portion 75 advantageously accompanies the beginning of rotation of the lid portion 75, that is, when the air flow produced by the air flow nozzle 90 is strongest, the lid portion 75 is prevented from being rotated too abruptly.

When the lid portion 75 is completely opened with respect to the housing portion 74, the conveying mechanism removes the case 5 from the opening station 85 and conveys the case along the feed line "AA" to one or more work stations "B" and "C", wherein assembling of the different components of the case is performed to create a finished compact disc case. More particularly, if the finished packaging case 5 is the type of case illustrated in FIG. 13, the leaflet 88, the booklet 34, the tray 77 and the compact disc 72 are inserted into the case 5, whereas if the finished packaging case is the type of case illustrated in FIG. 14, only the compact disc 72 and cover 81 are introduced thereinto.

For the above operations, the case 5 is advantageously transferred from the opening station 85 to a first work station "B" by the conveying mechanism performing one movement step. As shown in FIG. 10, a leaflet inserting mechanism 91 for inserting the leaflets into the case and a booklet inserting mechanism 92 for inserting the booklets into the case are provided at the first work station "B" at respectively opposite sides of the feed line "A".

The leaflet-inserting mechanism 91 includes a magazine 93 in which the leaflets 78 are stacked upon each other. The leaflets 78 are individually removed from the bottom of the stack as described above with respect to FIGS. 3–9 and transferred to a shaping mold 94 positioned adjacent the feed line "A". The leaflet-inserting mechanism 91 further includes a plate-like countermold 95 which is movable, in response to command of actuators (not shown), both in a vertical direction and in a horizontal direction perpendicular to the feed line "A". This plate-like countermold 95 can be introduced vertically into a shaping mold 94 to create a fold along the two side flaps 78*a* of the leaflet 78. The countermold 95 is then subsequently raised and moved horizontally to move the leaflet over the housing portion 74 of the case 5 located at the first work station "B". In this position, when the countermold 95 is moved downwardly, the leaflet, 78 is inserted into the housing portion 74 of the case. The countermold is then moved away from the case 5 into a position over the shaping mold 94, and meanwhile, a new leaflet 78 has been received therein for processing. The leaflets 78 are received and released by the countermold 95 by means of ducts (not shown) formed as openings within the lower surface of the countermold and through which a suction action can be selectively started and interrupted to enable retention and release of each leaflet 78.

The booklet-inserting mechanism 92 in turn provides for the booklets 34, provided by the unit for individually feeding brochures, to be moved to the first work station "B" by a belt conveyor 96 which extends parallel to the feed line "A". As the cases approach work station "B", the individual booklets 34 are received by the belt conveyor 96 by means of a grasping member 97 movable in a vertical and a horizontal direction, and also rotatable about a vertical axis, in response to actuators (not shown).

The grasping member 97 is adapted to pick up the booklet 34 and, upon rotation of the grasping member 97, if necessary, positioning its back edge 9*a* towards the case 5. In this manner, the booklet 34 is laid down onto a platform 98 disposed adjacent to the feed line "A" on the opposite side thereof relative to the shaping mold 94.

A second grasping member 92 movable along two axes, in the same manner as the plate-like countermold 95, receives the booklet 34 from the platform 98 and inserts the booklet between the inner surface of the lid portion 75 and the retaining tabs 80 associated therewith. A pair of guide blocks 99 which may be linked to the plate-like countermold 95 ensures the correct placement of the booklet edges 34*a* under the retaining tabs 80, thereby preventing the tabs from being undesirably passed over the edges of the booklet 34.

Obviously, the leaflet inserting mechanism 91 and the booklet inserting mechanism 92 arranged in the first work station "B" are activated during the packaging of compact discs 72 into cases 5 of the type shown in FIG. 13, whereas the leaflet inserting mechanism and booklet inserting mechanism are inactive if the compact discs 72 are to be packaged into cases 5 of the type devoid of a tray 77, such as shown in FIG. 14.

A second work station "C" is provided downstream of the first work station "B" which includes a compact disc inserting mechanism generally denoted by 100. The compact disc inserting mechanism 100 includes a compact disc feeding unit 101 adapted to individually arrange the compact discs 72 at a predetermined grasping position. As a result thereof, the feeding unit 101 is comprised of a second belt conveyor 102, extending horizontally at a lower position than the feed line "A", and along which one or more loading spindles 103 are arranged. Each spindle carries a predetermined number of compact discs 72 which are inserted over a vertical rod 103*a* of the spindle. The loading spindle 103 is aligned with the second work station "C", such that a lifting fork 104*a* is introduced under a support plate associated with the spindle, to lift the compact disc stack until the uppermost compact disc 72 reaches the desired grasping position, preferably coplanar with the feed line "A".

The compact disc inserting mechanism 100 also includes a disc transferring unit 105 movable with a reciprocating motion in a direction perpendicular to the feed line "A". The disc transferring unit 105 includes a first grasping head 106 movable in a vertical direction and designed to receive the compact disc 72 by means of a suction effect produced through ducts opening provided in the lower surface thereof, and subsequently position the compact disc 72 on a centering pin 107 mounted to the bearing framework 2. A second grasping head 108, similar to the first head 106, is provided which is adapted to receive the compact disc 72 from the centering pin 107 and transfer it to an assembling position where, if packaging into cases 5 of the type illustrated in FIG. 13, a tray 77 is positioned in the case which has been transferred to that position by a tray-feeding unit generally denoted by 109.

The tray-feeding unit 109 includes a tray-holding magazine 110 in which the trays 77 are vertically stacked so that they can be picked up one by one starting from the lower end of the stack upon the action of a first transferring mechanism (not shown). As illustrated in FIG. 10, the tray-feeding unit 109 also includes a second transferring mechanism having an auxiliary belt conveyor 111 extending in parallel relation to the feed line "A" which is adapted to be used for positioning the trays 77 from the feeding unit into an assembling position. In particular, the auxiliary belt conveyor 111 can be used for feeding trays 77 of the type usually provided with two engagement seats 77*a* on opposite faces for receiving two compact discs 72. In this case, the trays 77 transferred by the auxiliary belt conveyor 111 are trays 77 already provided with one compact disc 72 previously supplied by a separate equipment and optionally connected to the apparatus 70 by another belt conveyor mechanism or the like.

A third grasping head 112 associated with the transferring unit 105 receives the compact disc 72 from the assembling position and transfers it into the housing portion 74 of the case 5. If cases 5 of the type illustrated in FIG. 14 are utilized, the tray-feeding unit 109 remains inactive and the third head 112 receives from the assembling position, only the compact disc 72 which will be directly introduced into the housing portion 74 of the case.

If the cases 5 being processed are of the type illustrated in FIG. 13, the compact disc 72 positioned in the assembling position is moved into engagement with the seat 77*a* of the tray 77 upon the action of the second grasping head 108. Subsequently, the tray 77 is transferred together with the compact disc 72 into the housing portion 74, upon the action of the third grasping head 112.

Thrust arms 112*a* can also be associated advantageously with the third grasping head 112. Upon insertion of the compact disc 72 and tray 77 into the housing portion 74, the thrust arms 112*a* exert a thrust action upon Opposite corners of the tray 77 to ensure the correct engagement position of the tray 77 within the case 5.

Advantageously, a cover-inserting mechanism identified by reference numeral 113 in FIG. 10 is also associated with the second work station "C". The cover-inserting mechanism 113 operates at a symmetrically opposite position relative to the compact disc-inserting mechanism 100 and is adapted to be operated selectively and alternatively in response to operation of the leaflet-inserting mechanism 91, booklet-inserting mechanism 92 and tray-feeding unit 109, in order to place a cover 81 on the inner face of the case lid 5, when the case 5 is of the type devoid of trays 77, as shown in FIG. 14.

In order to achieve this result, the cover-inserting mechanism 113 essentially causes the first belt conveyor 96 to transfer the covers 81 to the second work station "C", instead of transferring the booklets 34. An auxiliary grasping member 113, similar in structure and operation to the grasping member 97 previously described with reference to the booklet-feeding mechanism, receives the individual covers 81 from the belt conveyor 96 and, after a rotation about a vertical axis if necessary, lays them onto a bending mold 115 disposed alongside the feed line "A". A front edge 116*a* of an auxiliary countermold 116 which conforms in shape to the pocket-like seating 82 is lowered onto the bending mold 115 and causes the end border 11*a* of the cover 81 initially disposed in a flat configuration to be bent upwardly, as a result of the force applied by the auxiliary countermold 116. The cover 81 with its border 81*a* bent upwardly is then moved away from the bending mold 115 and is positioned on the inner surface of the lid 75. During this step, the front edge 116*a* of the auxiliary countermold 116*a* enters the pocket-like seating 82 forcing the end border 81*a* of the cover 81 to take an "U-shaped" bent configuration conforming to the pocket-like seating itself.

A closing station 117 is provided along the feed line "A" downstream of the second work station "C". At the closing station, the lid portion 75 is returned to its closed condition.

Advantageously, the closing station 117 includes at least one second air blowing nozzle 118 fastened to the bearing framework 2 which is designed to direct an air flow against the lid portion 75 to move the lid portion from the open condition to the half-closed condition.

A presser mechanism is also associated with the closing station 117 which impinges upon the lid portion 75 when the lid portion is in its half-closed condition to push the lid portion towards the housing portion 74, so that the lid portion will return to its closed condition. In this manner, the resistance of snap-closing mechanism conventionally interposed between the housing portion and the lid portion is unnecessary.

In a preferred embodiment, the presser mechanism is formed of an idle roller 119 rotatably supported on the bearing framework 2 about an axis perpendicular to the translational movement imparted to the case 5 by the conveyor mechanism. The idle roller 119 impinges upon the lid portion 75 as soon as the case 5 is displaced from the closing station 117 by the conveyor mechanism.

The cases 5 exiting the closing station 117 can be removed from the packaging apparatus 70 by an outfeed conveyor 120, and/or stacked upon each other by a stacker 121. In one preferred embodiment, the presence both of the outfeed conveyor 120 and the stacker 121 is provided and they are employed selectively for removing the finished products and respectively arranging defective products in a stack or vice-versa.

As a result of the present invention, the opening and/or closing of the case lid portion is achieved by an apparatus which is greatly simplified in structure as compared with those of the known art.

Moreover, rotation of the lid portion to the open and/or closed position, obtained by an air flow, advantageously overcomes all the difficulties present in the known art as a result of the necessity of mechanically forcing the lid to rotate in an angular travel through 180° in a very short period of time (on the order of a few fractions of one second), while contemporaneously accomplishing closing and opening of the lid portion with refined force and preciseness in order to prevent damage to the case and/or breakage of same.

It should be also recognized that since the components described herein utilized to insert the leaflets, booklets, covers and compact discs are concentrated in two work stations and at mutually opposite positions with respect to the feed line, an enhanced versatility of the apparatus is achieved, while at the same time reducing the bulkiness of the overall apparatus.

While the present invention has been particularly shown and described with reference to a preferred embodiment, it will be readily apparent to those of ordinary skill in the art that various changes and modifications may be made therein without departing from the spirit and scope of the invention. It is intended that the appended claims be interpreted as including the foregoing as well as various other such changes and modifications.

I claim:

1. A case-feeding unit for use in conjunction with an automatic apparatus for packaging manufactured articles into cases, the case-feeding unit comprising:

a feeding magazine having vertical holding walls and arranged to house a plurality of cases disposed vertically in the form of a stack;

case separation means positioned adjacent to a lower end of the feeding magazine for removing a single case from said stack;

a base platform adapted to receive a new case stack of a predetermined height;

transferring means operating adjacent to said base plate for introducing the new case stack into the feeding magazine by horizontally moving said new case stack through an entrance side of said magazine defined between said holding walls and said transferring means automatically retracting to its initialized position when the new case stack is inserted into the feeding magazine, said transferring means moving said new case stack into the feeding magazine in a position such that the horizontal plane of a lowermost case in said stack remains substantially unchanged; and sensor means associated with said feeding magazine actuating said transferring means when the height of said stack in said magazine falls below a predetermined level.

2. The case-feeding unit as claimed in claim 1, wherein said transferring means comprises at least one vertically extending pusher member having a height at least substantially equal to the predetermined height of said new case stack and selectively movable between a first position, wherein said pusher member is spaced away from said entrance side of said feeding magazine, and a second position, wherein said pusher member is disposed adjacent to said entrance side to abut and move said new case stack into said feeding magazine.

3. The case-feeding unit as claimed in claim 2, wherein said pusher member is fastened to a movement arm pivotally mounted about a vertical support member and movable upon activation of at least one fluid-operated actuator.

4. The case-feeding unit as claimed in claim 2, wherein said pusher member comprises at least one central support bar and a plurality of contact rollers rotatably engaged along said central support bar in a mutually superposed relation.

5. The case-feeding unit as claimed in claim 4, wherein said contact rollers impinge upon said new case stack to move said new stack through said entrance side of said magazine and into abutment with at least one vertical holding wall of said magazine.

6. The case-feeding unit as claimed in claim 3, wherein said movement arm has at least one extension portion extending transversely in cantilevered fashion from the movement arm in the direction of the feeding magazine and to which said pusher member is connected.

7. The case-feeding unit as claimed in claim 1, further comprising retaining means for retaining said case stack in its proper position in said feeding magazine, said retaining means being selectively movable between a rest condition, wherein said retaining means is laterally spaced away from said entrance side of said feeding magazine to enable access of said new case stack into said feeding magazine, and an operating condition, wherein said retaining means is moved adjacent to said entrance side to stabilize the positioning of said case stack within said feeding magazine.

8. A method for automatically feeding cases into an automatic apparatus for packaging manufactured articles into cases, said method comprising the following steps:

introducing into a feeding magazine by a transferring mechanism a plurality of cases disposed in the form of a stack and extending vertically in the magazine;

individually removing the cases from the bottom of said stack;

arranging a new case stack on a base platform positioned in front of an entrance side of said feeding magazine;

automatically retracting said transferring mechanism to its initialized portion when the new case stack is inserted into the feeding magazine;

horizontally displaying said new case stack through said entrance side so as to introduce said new case stack into said feeding magazine when the height of said stack in said feeding magazine falls below a predetermined level in a position such that the horizontal plate of a lowermost case in said stack remains substantially unchanged.

9. A case-feeding unit for use in conjunction with an automatic apparatus for packaging manufactured articles into cases, the case-feeding unit comprising:

a feeding magazine having vertical holding walls and arranged to house a plurality of cases disposed vertically in the form of a stack;

case separation means positioned adjacent to a lower end of the feeding magazine for removing a single case from said stack;

a base platform adapted to receive a new case stack of a predetermined height;

transferring means operating adjacent to said base platform for introducing the new case stack into the feeding magazine by horizontally moving said new case stack through an entrance side of said magazine defined between said holding walls, said transferring means comprising at least one vertically extending pusher member having a height at least substantially equal to the predetermined height of said new case stack and selectively movable between a first position, wherein said pusher member is spaced away from said entrance side of said feeding magazine, and a second position, wherein said pusher member is disposed adjacent to said entrance side to abut and move said new case stack into said feeding magazine, and wherein said pusher member is fastened to a movement arm pivotally mounted about a vertical support member and movable upon activation of at least one fluid-operated actuator; and sensor means associated with said feeding magazine for actuating said transferring means when the height of said stack in said magazine falls below a predetermined level.

10. The case-feeding unit as claimed in claim 9, wherein said movement arm has at least one extension portion extending transversely in cantilevered fashion from the movement arm in the direction of the feeding magazine and to which said pusher member is connected.

11. A case-feeding unit for use in conjunction with an automatic apparatus for packaging manufactured articles into cases, the case-feeding unit comprising:

a feeding magazine having vertical holding walls and arranged to house a plurality of cases disposed vertically in the form of a stack;

case separation means positioned adjacent to a lower end of the feeding magazine for removing a single case from said stack;

a base platform adapted to receive a new case stack of a predetermined height;

transferring means operating adjacent to said base platform for introducing the new case stack into the feeding magazine by horizontally moving said new case stack through an entrance side of said magazine defined between said holding walls, said transferring means comprising at least one vertically extending pusher member having a height at least substantially equal to the predetermined height of said new case stack and selectively movable between a first position, wherein said pusher member is spaced away from said entrance side of said feeding magazine, and a second position, wherein said pusher member is disposed adjacent to said entrance side to abut and move said new case stack into said feeding magazine, and wherein said pusher member comprises at least one central support bar and a plurality of contact rollers rotatably engaged along said central support bar in a mutually superposed relation; and sensor means associated with said feeding magazine for actuating said transferring means when the height of said stack in magazine falls below a predetermined level.

12. The case-feeding unit as claimed in claim 11, wherein said contact rollers impinge upon said new case stack to move said new stack through said entrance side of said magazine and into abutment with at least one vertical holding wall of said magazine.

13. The case-feeding unit as claimed in claim 11, and further comprising retaining means for retaining said case stack in its proper position in said feeding magazine, said retaining means being selectively movable between a rest condition, wherein said retaining means is laterally spaced away from said entrance side of said feeding magazine to enable access of said new case stack into said feeding magazine, and an operating condition, wherein said retaining means is moved adjacent to said entrance side to stabilize the positioning of said case stack within said feeding magazine.

* * * * *